US006202980B1

(12) United States Patent
Vincent et al.

(10) Patent No.: US 6,202,980 B1
(45) Date of Patent: Mar. 20, 2001

(54) ELECTRONIC FAUCET

(75) Inventors: Raymond A. Vincent, Plymouth; Jeffrey J. Iott, Monroe; Randall P. Schmitt, Clinton Township; John Kirk, Grosse Pointe Farms, all of MI (US)

(73) Assignee: Masco Corporation of Indiana, Taylor, MI (US)

( * ) Notice: Subject to any disclaimer, the term of this patent is extended or adjusted under 35 U.S.C. 154(b) by 0 days.

(21) Appl. No.: 09/232,303

(22) Filed: Jan. 15, 1999

(51) Int. Cl.[7] ..... F16K 31/02
(52) U.S. Cl. ..... 251/129.04; 4/623
(58) Field of Search ..... 4/623; 251/129.04; 137/801

(56) References Cited

U.S. PATENT DOCUMENTS

| | | |
|---|---|---|
| Re. 35,018 | 8/1995 | Homan . |
| 3,415,278 | 12/1968 | Yamamoto et al. . |
| 3,556,146 | 1/1971 | Groen . |
| 3,576,277 | 4/1971 | Blackman . |
| 3,585,652 | 6/1971 | Forbes et al. . |

(List continued on next page.)

FOREIGN PATENT DOCUMENTS

404124328 * 4/1992 (JP) ..... 4/623

*Primary Examiner*—John Rivell
*Assistant Examiner*—Meredith H Schoenfeld
(74) *Attorney, Agent, or Firm*—Reising, Ethington, Barnes, Kisselle, Learman & McCulloch, P.C.

(57) ABSTRACT

An electronic faucet having a spout, a electronically actuated valve, and a microprocessor-based control circuit for operating the valve to enable or disable water flow through the spout. The microprocessor has a control program which includes a calibration routine that uses an infra-red sensor to determine an adjustable setpoint indicative of the signal received from the sensor in the absence of an object in front of the faucet. The microprocessor switches the valve from its closed state to its open state when the signal from the sensor either increases above the setpoint by a selected amount or decreases below the setpoint by a selected amount. This provides a window about the setpoint within which differences between the setpoint and the signal do not result in opening of the valve. Object detection is accomplished using a tracking routine that adjusts the setpoint in an attempt to track the sensor signal. If the sensor signal undergoes a change that is too large to be tracked, then the microprocessor switches on the valve. Once the sensor signal drops back into a range of values about a stored calibration point, the valve is closed. The control circuit is part of an electronics module that is mounted within the spout and that is held in place between the spout tube and the spout housing. The module includes a curved recess having a shape that conforms to the spout tube so that the module is retained in place at its upper end by the spout tube.

21 Claims, 18 Drawing Sheets

U.S. PATENT DOCUMENTS

| | | | | |
|---|---|---|---|---|
| 3,585,653 | | 6/1971 | Forbes et al. . | |
| 3,639,920 | | 2/1972 | Griffin et al. . | |
| 3,726,296 | | 4/1973 | Friedland et al. . | |
| 3,752,171 | | 8/1973 | Ayre . | |
| 4,141,383 | | 2/1979 | Geimer . | |
| 4,309,781 | | 1/1982 | Lissau . | |
| 4,333,490 | | 6/1982 | Enter, Sr. . | |
| 4,520,516 | | 6/1985 | Parsons . | |
| 4,604,764 | | 8/1986 | Enzo . | |
| 4,606,085 | | 8/1986 | Davies . | |
| 4,681,141 | | 7/1987 | Wang . | |
| 4,682,628 | | 7/1987 | Hill . | |
| 4,688,277 | | 8/1987 | Kakinoki et al. . | |
| 4,709,728 | | 12/1987 | Ying-Chung . | |
| 4,735,357 | | 4/1988 | Gregory et al. . | |
| 4,741,363 | | 5/1988 | Hu . | |
| 4,762,273 | | 8/1988 | Gregory et al. . | |
| 4,767,922 | | 8/1988 | Stauffer . | |
| 4,788,998 | | 12/1988 | Pepper et al. . | |
| 4,823,414 | | 4/1989 | Piersimoni et al. . | |
| 4,826,129 | | 5/1989 | Fong et al. . | |
| 4,872,485 | | 10/1989 | Laverty, Jr. . | |
| 4,886,207 | | 12/1989 | Lee et al. . | |
| 4,894,874 | | 1/1990 | Wilson . | |
| 4,915,347 | | 4/1990 | Iqbal et al. . | |
| 4,916,613 | | 4/1990 | Lange et al. . | |
| 4,921,211 | | 5/1990 | Noval et al. . | |
| 4,928,732 | * | 5/1990 | Hu | 137/607 |
| 4,931,938 | | 6/1990 | Hass . | |
| 4,941,219 | | 7/1990 | Van Marcke . | |
| 4,945,943 | | 8/1990 | Cogger . | |
| 4,953,236 | * | 9/1990 | Lee et al. | 4/623 X |
| 4,955,535 | | 9/1990 | Tsutsui et al. . | |
| 4,962,790 | * | 10/1990 | Chou et al. | 251/129.04 X |
| 4,971,106 | | 11/1990 | Tsutsui et al. . | |
| 4,972,070 | | 11/1990 | Laverty, Jr. . | |
| 4,981,158 | | 1/1991 | Brondolino et al. . | |
| 4,995,585 | | 2/1991 | Grubert et al. . | |
| 5,012,667 | | 5/1991 | Kruse . | |
| 5,025,516 | | 6/1991 | Wilson . | |
| 5,033,508 | | 7/1991 | Laverty, Jr. . | |
| 5,033,715 | | 7/1991 | Chiang et al. . | |
| 5,063,622 | | 11/1991 | Tsutsui et al. . | |
| 5,086,526 | | 2/1992 | Van Marcke . | |
| 5,092,560 | | 3/1992 | Chen . | |
| 5,095,945 | | 3/1992 | Jensen . | |
| 5,131,428 | * | 7/1992 | Bory | 137/801 X |
| 5,133,095 | | 7/1992 | Shiba et al. . | |
| 5,184,642 | | 2/1993 | Powell . | |
| 5,217,035 | | 6/1993 | Van Marcke . | |
| 5,224,509 | | 7/1993 | Tanaka et al. . | |
| 5,224,685 | | 7/1993 | Chiang et al. . | |
| 5,226,629 | | 7/1993 | Millman et al. . | |
| 5,243,717 | | 9/1993 | Yasuo . | |
| 5,281,808 | | 1/1994 | Kunkel . | |
| 5,322,086 | | 6/1994 | Sullivan . | |
| 5,358,213 | * | 10/1994 | Pilolla | 251/129.04 X |
| 5,458,147 | * | 10/1995 | Mauerhofer | 251/129.04 X |
| 5,482,250 | | 1/1996 | Kodaira . | |
| 5,504,950 | | 4/1996 | Natalizia et al. . | |
| 5,549,273 | | 8/1996 | Aharon . | |
| 5,555,912 | | 9/1996 | Saadi et al. . | |
| 5,566,702 | * | 10/1996 | Philipp | 251/129.04 X |
| 5,570,869 | | 11/1996 | Diaz et al. . | |
| 5,577,660 | | 11/1996 | Hansen . | |
| 5,611,517 | | 3/1997 | Saadi et al. . | |
| 5,625,908 | | 5/1997 | Shaw . | |
| 5,634,778 | | 6/1997 | Leigel et al. . | |
| 5,638,863 | | 6/1997 | Whang et al. . | |
| 5,655,749 | * | 8/1997 | Mauerhofer | 251/129.04 |
| 5,694,653 | | 12/1997 | Harald . | |
| 5,758,688 | | 6/1998 | Hamanaka et al. . | |
| 5,816,336 | | 10/1998 | Gilliam et al. . | |
| 5,868,311 | * | 2/1999 | Cretu-Petra | 4/623 X |
| 5,961,095 | * | 10/1999 | Schrott | 251/129.04 |
| 6,003,170 | * | 12/1999 | Humpert et al. | 4/623 |

* cited by examiner

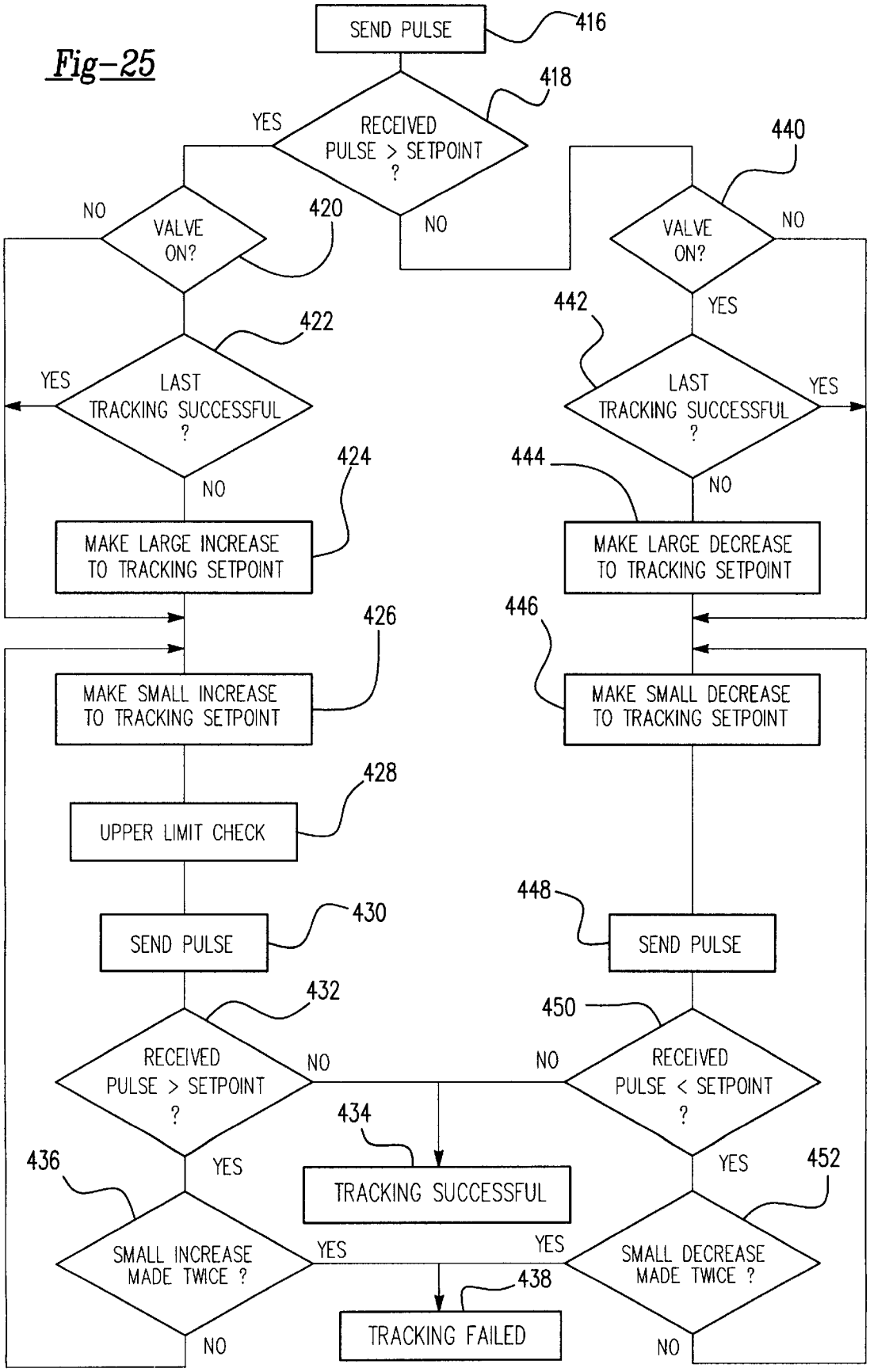
Fig-25
SEND PULSE
416
RECEIVED PULSE > SETPOINT ?
418
YES
NO
VALVE ON?
420
NO
LAST TRACKING SUCCESSFUL ?
422
YES
NO
MAKE LARGE INCREASE TO TRACKING SETPOINT
424
MAKE SMALL INCREASE TO TRACKING SETPOINT
426
UPPER LIMIT CHECK
428
SEND PULSE
430
RECEIVED PULSE > SETPOINT ?
432
NO
YES
SMALL INCREASE MADE TWICE ?
436
YES
NO
TRACKING SUCCESSFUL
434
TRACKING FAILED
438
VALVE ON?
440
NO
YES
LAST TRACKING SUCCESSFUL ?
442
YES
NO
MAKE LARGE DECREASE TO TRACKING SETPOINT
444
MAKE SMALL DECREASE TO TRACKING SETPOINT
446
SEND PULSE
448
RECEIVED PULSE < SETPOINT ?
450
NO
YES
SMALL DECREASE MADE TWICE ?
452
YES
NO

ELECTRONIC FAUCET

TECHNICAL FIELD

The present invention relates to electronic faucets of the type that are automatically controlled by object detection circuitry so that a user can start water flow through the faucet without any physical contact required.

BACKGROUND OF THE INVENTION

Electronic faucets of the type contemplated herein are increasingly used in public restrooms and other commercial applications to help prevent the transmission of infectious organisms and to help reduce the waste of potable water due to callous or mischievous conduct by the users. These electronic faucets can be activated by a user without any physical contact and are typically designed to only permit water flow when a user or other object is detected at the faucet.

Such faucets are well known in the art. See, for example, U.S. Pat. No. 5,555,912 to Saadi et al., U.S. Pat. No. 5,224,509 to Tanaka et al., U.S. Pat. No. 4,767,922 to Stauffer, and U.S. Pat. No. 4,709,728 to Ying-Chung. As these patents demonstrate, active infra-red (IR) detectors in the form of photodiode pairs are commonly used in these faucets for object detection. Pulses of IR light are emitted by one diode with the other being used to detect reflections of the emitted light off an object in front of the faucet. Different designs utilize different locations on the spout for the photodiodes, including placing them at the head of the spout, as in the Saadi et al. and Tanaka et al. patents, or farther down the spout near its base, as in the Stauffer and Ying-Chung patents. Some have proposed placing the emitter and receiver at different locations, as in U.S. Pat. No. 5,549,273 to Aharon, while others have proposed IR transceivers that are entirely separate from the spout, as in U.S. Pat. No. 5,625,908 to Shaw and U.S. Pat. No. 5,577,660 to Hansen.

Apart from the location of the IR sensor elements, a number of other design considerations exist in the use of active IR sensors, including how the sensors will be oriented, where the control electronics will be located, and how the sensors will be utilized to make decisions regarding switching the faucet on and off. Generally, the orientation of the sensors determines their field of view. In most designs the sensors are oriented either horizontally (i.e., so that their optical axes are parallel to the bottom surface of the spout base) or downwardly (i.e., inclined downwards into the sink basin). A benefit of horizontally orienting the sensors is that a user's hands can be detected sooner than if the sensors are oriented downwardly. However, one problem with horizontal orientation is that upon the faucet switching on, the water stream may reflect the transmitted IR light, even when the object that triggered the faucet is no longer present. One technique for compensating for this reflected light is disclosed in U.S. Pat. No. 5,566,702 to Philipp. In the Phillip design, the amount of reflected IR light due to the water stream is determined and then, during normal use, this amount is subtracted from the signal received whenever the faucet is running. Faucets utilizing downwardly directed sensors do not typically have this same problem and can be designed so that no special processing of the reflected light is required to accommodate the water stream. See, for example, U.S. Pat. No. 4,894,874 to Wilson. However, as indicated above, these designs typically result in an undesirable characteristic; namely, that they do not detect a user's hands and start the water flow until the user's hands are directly underneath the faucet.

The active IR sensors are operated by a control circuit that activates the LED transmitter and then monitors the LED receiver for reflections of the infra-red light. In some instances, the control circuit is mounted within the spout itself, as in the Wilson patent and U.S. Pat. No. 4,872,485 to Laverty, Jr. In other cases, it is designed to be located with the valve or in some other location under the sink, such as in U.S. Pat. No. 4,823,414 to Piersimoni et al. and U.S. Pat. No. 4,604,764 to Enzo. Locating the control circuit within the spout itself can create complications that may result in an overly complex mounting scheme or in a mounting scheme in which the electronics remain accessible after installation of the faucet. For example, in the Wilson patent, the printed circuit board is screwed onto a base in an arrangement that takes up a considerable amount of the space within the spout and that is easily accessible even after installation. Such access may be undesirable in commercial applications where, once installed, the faucet may be subjected to mischievous tampering or vandalism.

One of the difficulties in providing a consistent operation in which the faucet switches on and off at the appropriate times is in designing a control circuit that can properly interpret the signals received from the IR sensor and that can adjust to abnormal circumstances and changes in ambient conditions. To this end, the control circuits are increasingly becoming microprocessor based circuits that utilize sophisticated algorithms to operate the IR sensors and interpret the received signals. Many of these algorithms are variants on the basic approach of comparing the received signals to a threshold value that represents a background reading of the reflected IR and, if the received signal is greater than the threshold, then the presence of an object is assumed and the water flow is switched on. See, for example, the above-noted patents to Philipp and Aharon, as well as U.S. Pat. No. 5,217,035 to Van Marcke. As shown in the Philipp patent, this comparison can be accomplished using an analog comparator that compares the received signal to a reference with the output of the comparator providing a binary input to the circuit 's microprocessor. The reference voltage can be generated through software by using an output of the microprocessor to charge the capacitor for a certain length of time and, therefore, to a certain votage.

These circuits may also include calibration routines that are used to initially determine the proper threshold or reference voltage and to periodically adjust for slow changes in ambient conditions. See, for example, the Philipp patent and U.S. Pat. No. 5,570,869 to Diaz et al. In the Philipp faucet, the IR sensor is periodically used to take a current background reading which is compared to a stored background reference level. The stored background level is then incrementally adjusted up or down depending upon whether the current background reading is more or less than the stored value. In the Diaz et al. faucet, a continuous calibration approach is used to calibrate to all detected changes, including those for which activation of the faucet is desired. As with the Philipp faucet, the Diaz et al. control circuit compares reflected IR pulses to a reference voltage and initiates water flow when the signal strength due to the reflected pulses exceeds the reference. However, the Diaz et al. circuit automatically adjusts the strength of the transmitted IR pulses so that the signal due to the reflected pulses is equal to the reference voltage. The received signal and reference are provided as inputs to a comparator whose output is used to increase the strength of the IR pulses when the received signal is less than the reference and to decrease the strength of the IR pulses when the received signal is greater than the reference. In lieu of adjusting the strength of the transmitted IR pulses, the circuit can adjust the reference voltage to track changes in reflected signal strength. Consequently, the control circuit attempts to calibrate to all detected changes, including those due to the presence of the water stream or other object. This can be disadvantageous because, rather than detecting a baseline or background level, the circuit tracks all changes and the comparator's reference voltage is therefore undesirably affected by received signals that indicate a detected object.

One problem common to most currently available electronic faucets is that their control algorithms assume that the presence of a user's hands under the faucet will always result in an increase in reflected IR light. However, when such faucets are used in conjunction with metal or other highly-reflective sink basins, the presence of a user's hands under the faucet may actually decrease the amount of reflected IR light. Accordingly, there exists a need for an electronic faucet that can be used in any installation without the need for special setup procedures to accommodate the characteristics of the environment in which the faucet is placed. There also exists a need for an electronic faucet that provides a simple and effective mounting scheme for the control circuit and that precludes access to the electronics once the faucet has been installed.

SUMMARY OF THE INVENTION

In accordance with one aspect of the invention, there is provided an electronic faucet which provides improved object detection in a wide variety of different installations, while rejecting changes in ambient conditions and other such factors that could otherwise cause false triggering of the faucet. The electronic faucet includes a spout, spout tube, valve, and electronic control circuit for operating the valve to enable or disable water flow through the spout. The spout has a housing that extends from a base end of the housing to a distal free end. The spout tube extends through the housing from an opening in the base end to an opening in the free end. The valve has a water inlet, a water outlet, and at least one input that controls switching of the valve between an open state and a closed state. The electronic control circuit is coupled to the input of the valve and it includes a microprocessor, a memory accessible by the microprocessor, a control program stored in the memory, and a sensor coupled to the microprocessor. The sensor is supported by the housing and is operable to generate a signal indicative of the presence or absence of objects located within a region of space near the housing. The microprocessor is operable under control of the program to perform a calibration using the sensor to determine an adjustable setpoint indicative of the signal received from the sensor in the absence of a detected object within the region of space. The microprocessor is also operable under control of the program to switch the valve from the closed state to the open state when the signal from the sensor either increases above the setpoint by a selected amount or decreases below the setpoint by a selected amount. This provides a window about the setpoint within which differences between the setpoint and the signal do not result in switching of the valve to the open state.

Preferably, the object detection is carried out using a tracking routine that makes adjustments to the setpoint in an attempt to track the sensor signal. The setpoint is initially set equal to a stored calibration point that is determined during the calibration routine. A signal is acquired from the sensor and is examined to determine whether it is above or below the setpoint. The setpoint is then adjusted towards the sensor signal, either up or down, following which another sensor signal is acquired and checked to see if it is above of below the new (adjusted) setpoint. If the setpoint has been adjusted past the sensor signal, then the process was able to track the sensor signal within the window and the valve is not switched on. If the setpoint has not been adjusted past the sensor signal, then it is adjusted again in the same direction and another comparison with an updated signal from the sensor is made. These adjustment and comparison steps are carried out one or more times until the setpoint either is adjusted past the sensor signal, meaning that the tracking was successful, or is adjusted to one of the boundaries of the window, meaning that the tracking was unsuccessful. If the faucet cannot track the sensor signal within the window, then the presence of an object is assumed and the valve is switched on.

In accordance with another aspect of the invention, there is provided an electronic faucet which includes a spout and an infra-red detector having an upwardly directed field of view. The spout has a substantially planar mounting surface at its base end. The infra-red detector is supported by the housing proximate the base end, with the infra-red detector having an optical axis oriented in a direction that is generally parallel to the plane in which the mounting surface lies. The optical axis extends through an opening in an outer surface of the housing at a location in which the outer surface forms an obtuse angle with the mounting surface.

In accordance with another aspect of the invention, there is provided an electronic faucet in which the control circuit includes a support member that is retained between the spout tube and spout housing. The support member is used to support the microprocessor, memory, and other control circuit electrical components in the spout. The support member includes a first surface portion that is in contact with the spout tube and at least one other surface portion that is in contact with the housing. The spout tube can have a curved outer surface in which case the first surface portion of the support member comprises a curved bearing surface that is in contact with the curved outer surface of the spout tube.

In accordance with another aspect of the invention, the support member can be retained within the housing by a multi-point retention arrangement. In this arrangement, the support member is retained in the housing by contact with a first side of the support member at opposite ends thereof and by contact with a second side of the support member at one or more intermediate locations.

In accordance with yet another aspect of the invention, there is provided a spout assembly for an electronic faucet which includes a spout housing, a spout tube, and an electronics module interposed between the spout tube and spout housing, with the electronics module being retained within the spout housing in contact with both the spout tube and the spout housing. The spout tube can be part of a spout tube assembly, with the electronics module having upper and lower ends in abutment with the spout tube assembly and having at least one intermediate portion in abutment with the housing.

BRIEF DESCRIPTION OF THE DRAWINGS

A preferred exemplary embodiment of the present invention will hereinafter be described in conjunction with the appended drawings, wherein like designations denote like elements, and:

FIG. 25 is a flow chart depicting the tracking routine used in the control program to track the signals from the sensor;

DESCRIPTION OF THE PREFERRED EMBODIMENT

Figure 1:
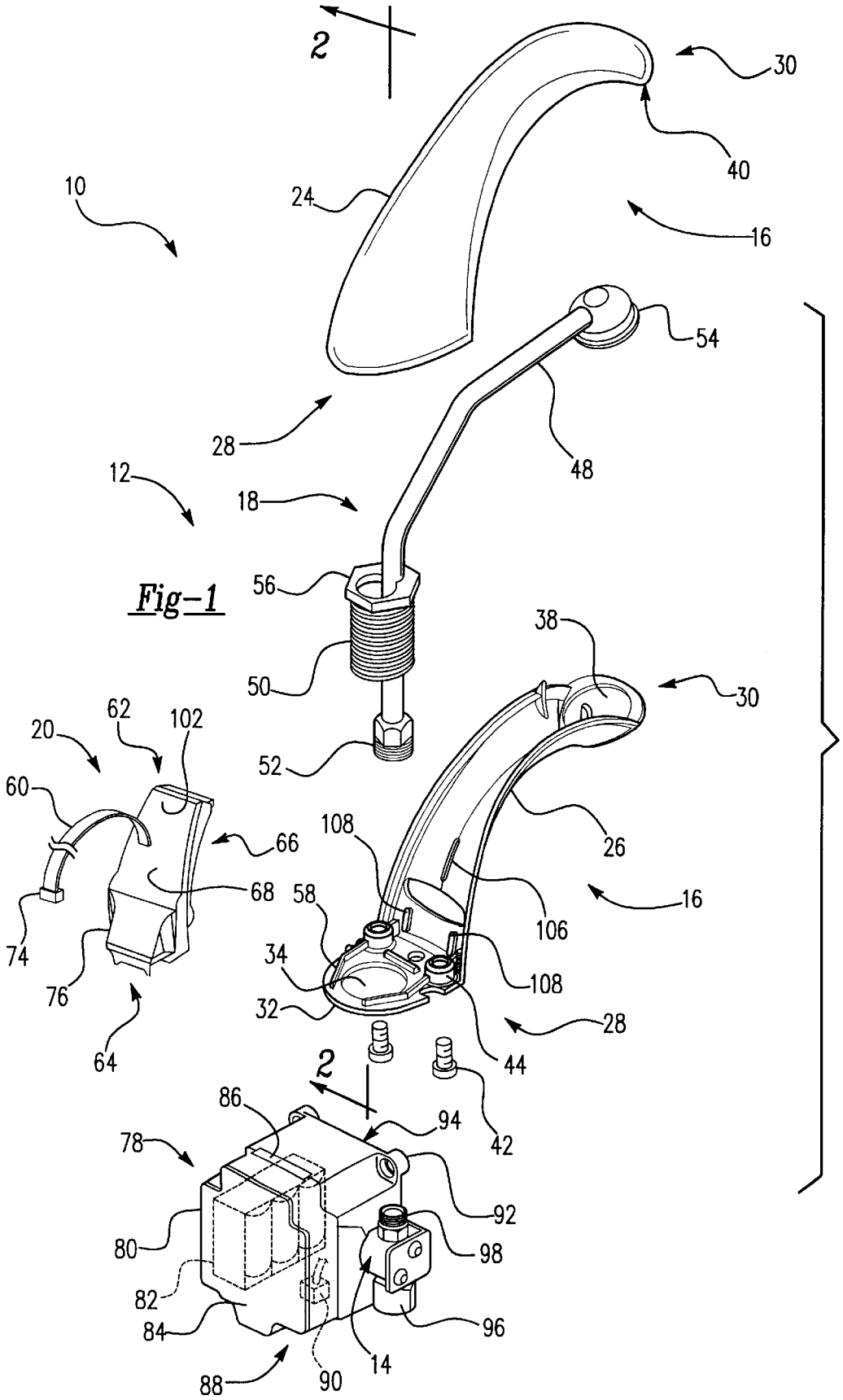
FIG. 1 is an exploded view depicting the main components of a preferred embodiment of an electronic faucet constructed in accordance with the present invention.
Figure 2:
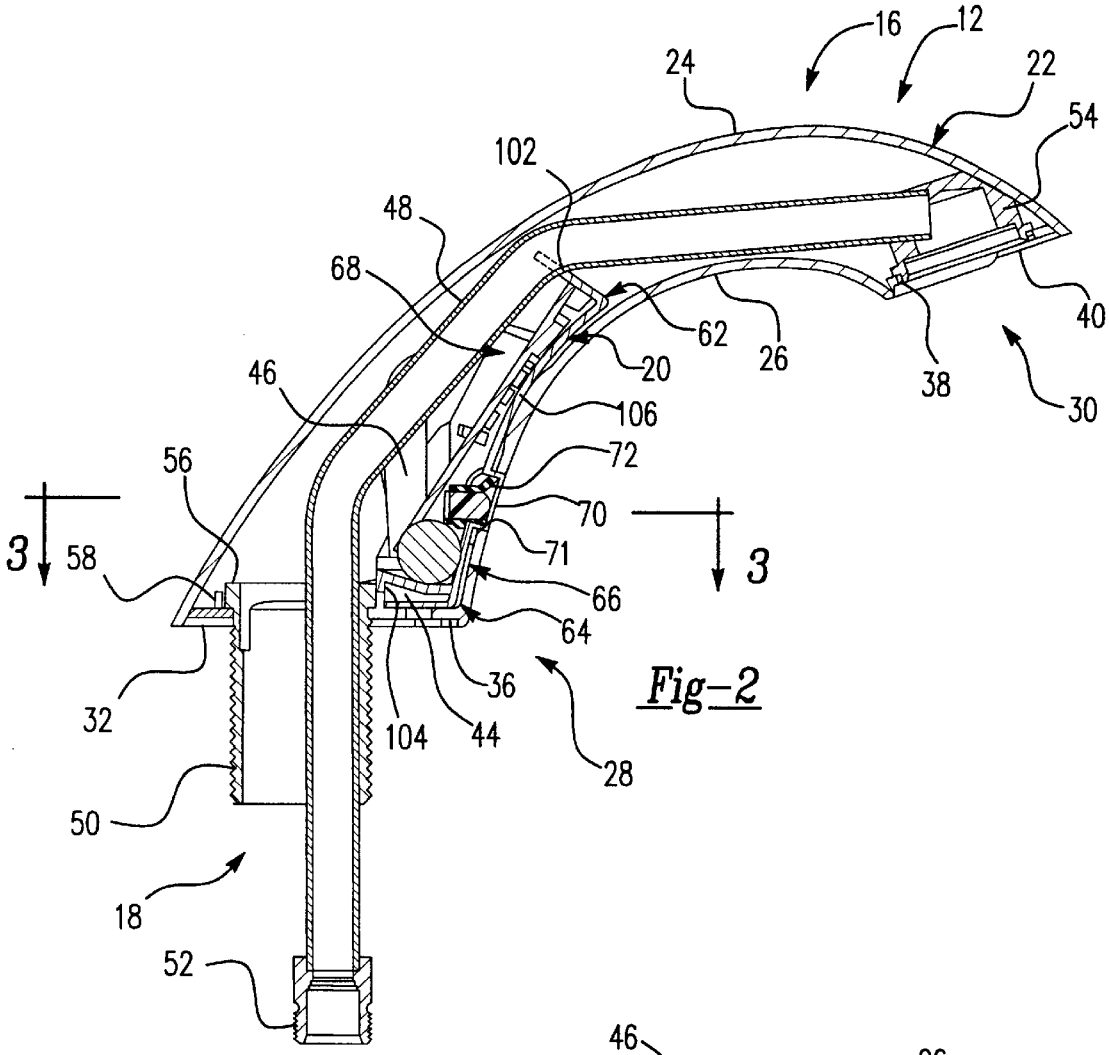
FIG. 2 is a vertical cross-sectional view of the assembled spout assembly of FIG. 1 taken along the 2—2 line of FIG. 1.
Figure 3:
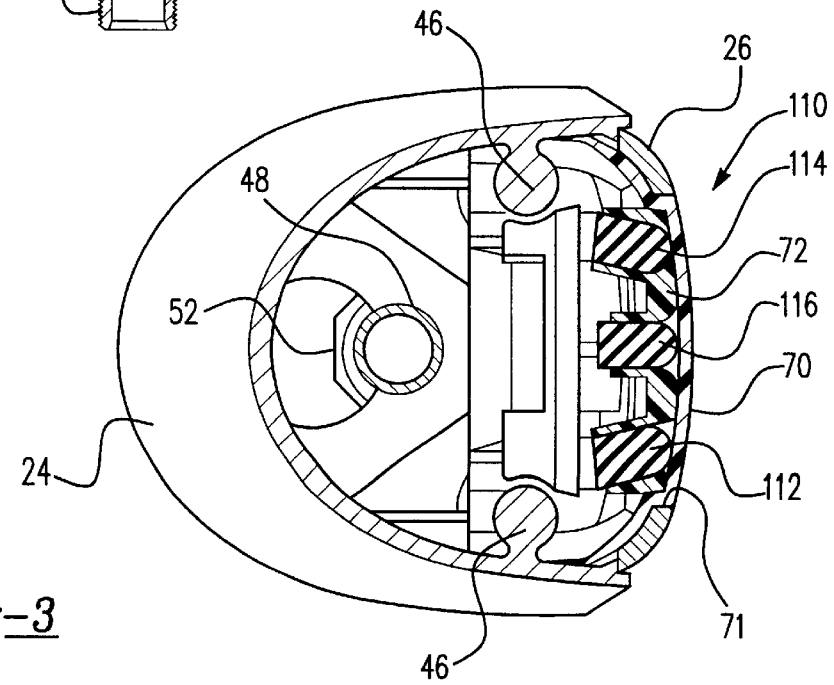
FIG. 3 is a horizontal cross-sectional view of the assembled spout assembly of FIG. 1 taken at the level depicted by the 3—3 line of FIG. 2.

Referring first to FIGS. 1–3, an electronic faucet, designated generally as 10, includes a spout assembly 12 that mounts on the top of a sink or vanity top (not shown) and an electronic valve 14 that mounts in a concealed location underneath the sink or vanity top. The spout assembly 12 includes as its main components a spout 16, a spout tube assembly 18, and an electronics module 20. In operation, electronics module 20 monitors a region of space in front of spout 16 and, in response to detecting an object within that space, switches on valve 14 to start the flow of water. Once the object is no longer detected, it switches off valve 14 to stop the flow of water.

Spout 16 comprises a two-piece housing 22 which includes an upper housing 24 and a lower housing 26 that fit together to enclose both spout tube assembly 18 and electronics module 20. Housing 22 extends from a base end 28 to a distal free end 30. Base end 28 includes a substantially planar mounting surface 32 having an opening 34 therein through which spout tube assembly 18 extends. Mounting surface 32 can include a recessed portion 36 for receiving a gasket to provide a seal between spout 16 and the sink or vanity top. Free end 30 has an opening 38 through which the water exits spout 16. Upper housing 24 comprises a unitary cast metal covering having a decorative but durable finish such as chrome or polished brass. Lower housing 26 is also a unitary component and can be made of metal or plastic with a decorative coating. Free end 30 of lower housing 26 can fit within a lip 40 at free end 30 of upper housing 24, with a pair of screws 42 being used to secure the base end 28 of upper and lower housings 24, 26 together. Each screw 42 extends through a countersunk clearance hole 44 in the mounting surface 32 of lower housing 26 and then up into a screw post 46 in upper housing 24. When faucet 10 is installed, these screws will be concealed, thereby preventing spout assembly 12 from being loosened or disassembled while installed. Consequently, electronics module 20 is inaccessible and cannot be tampered with, except by destructive vandalism or access to the underside of the vanity on which the spout assembly is mounted.

Spout tube assembly 18 comprises a spout tube 48 that extends through a threaded shank 50 from a threaded connector 52 to a discharge outlet 54. The threaded shank 50 extends through opening 34 in base end 28 and is used both to secure spout 16 to a sink or other support structure and to provide a passage through which spout tube 48 extends. Shank 50 includes an integral nut 56 that mates with complementary retaining ribs 58 in lower housing 26 which prevent shank 50 from rotating during installation. Nut 56 includes a pair of bisecting circular openings, one of which is sized to accommodate spout tube 48 passing therethrough and the other of which is sized to permit an electronics cable 60 to extend therethrough for electrical connection between valve 14 and electronics module 20. Discharge outlet 54 can be of a conventional construction and can include internal threads to receive an optional aerator. Connector 52 at the opposite end of spout tube 48 can also be of a conventional construction such that it mates with a standard water supply line hose.

Electronics module 20 is designed to fit within the front, lower portion of spout 16. It includes an upper end 62, a lower end 64, a front side 66, and a back side 68. Front side 66 includes a projecting portion 70 that protrudes into a complementary opening or cutout 71 in lower housing 26. Located within this projecting portion 70 is a sensor housing 72. Electronics cable 60 extends from back side 68 and terminates at a modular plug 74. Back side 68 includes a pair of recesses 76 to provide clearance for screw posts 46 of upper housing 24. Further details of electronics module 20 will be discussed further below.

Valve 14 is a solenoid actuated valve that switches between an open state, in which it permits water flow through the valve, and a closed state, in which it prevents water flow through the valve. Valve 14 is one component of a valve assembly 78 that includes a plastic case 80 along with a battery pack 82. Access to battery pack 82 is by way of a lid 84 which swings upwardly about a hinge 86. The bottom wall 88 of case 80 includes an electrical socket connector 90 to which plug 74 is connected during installation. Case 80 includes four mounting holes 92 at its rear wall 94 for mounting to a suitable support. Valve 14 includes a conventional threaded connector 96 for connecting to a water supply line, as well as a conventional threaded connector 98 so that it may be hooked up to connector 52 on spout tube 48 using a standard flexible braided supply connection hose.

When spout assembly 12 is assembled together as shown in FIGS. 2 and 3, electronics module 20 is retained in place within spout 16 between lower housing 26 and spout tube 48. In particular, electronics module 20 is retained in place within spout 16 using a multi-point retention arrangement in which the back side 68 of module 20 contacts spout tube 48 at upper end 62 and contacts nut 56 of shank 50 at lower end 64 while the front side 66 contacts lower housing 26 at three spaced points on module 20 that are intermediate the upper and lower ends 62, 64. Electronics module 20 has a curved bearing surface or recess 102 on back side 68 at its upper end 62. Recess 102 conforms to the curved outer surface of spout tube 48 such that electronics module 20 is retained in place by the spout tube 48. Module 20 also includes a flange 104 on back side 68 at its lower end 64. Flange 104 abuts nut 56 which prevents the lower end 64 of module 20 from moving rearward. Lower housing 26 includes a central bearing surface 106 which bears against module 20 at its mid-section and includes a pair of lower bearing surfaces 108 which bear against module 20 near its lower end 64. These bearing surfaces each comprise the inside surface of a raised portion of the housing wall. These three protrusions can be formed simply by providing three individual areas of localized thickening of the housing wall. This support arrangement for module 20 is especially advantageous when lower housing 26 is made from a material such as zinc where it is difficult during manufacturing to control the wall thickness from one part to another, but is possible to create individual raised portions at a thickness that is repeatable from part to part.

Referring specifically to FIG. 3, electronics module 20 includes a detector, or sensor, 110 which is used to monitor a region of space in front of spout 16. Sensor 110 is located within the protruding portion 70 of module 20 such that it faces forwardly of spout 16. It is an active infra-red (IR) detector that comprises an infra-red LED transmitter 112 and an infra-red diode receiver 114. Located between these diodes is a standard LED 116 that transmits visible (red) light and that is used as an annunciator to provide a visible indication of various operating conditions, such as low battery voltage or operation of a calibration sequence. Sensor diodes 112 and 114 are oriented such that their optical axes converge slightly towards each other by approximately ten degrees. This provides them with a substantially overlapping field of view and a focal point of approximately eight inches in front of spout 16. Each of these diodes has a field of view that comprises an approximately forty degree solid angle. Each of these diodes is also oriented so that its optical axis is directed generally parallel the horizontal plane defined by mounting surface 32 of spout 16. This allows sensor 110 to detect a user's hands earlier, as they are moving downward toward the faucet and, therefore, enables faucet 10 to start the water flow sooner. As will be described in greater detail further below, the orientation of diodes 112 and 114 is determined by sensor housing 72, which provides this horizontal orientation at a location (cutout 71) in lower housing 26 where the surface of the housing forms an obtuse angle with respect to mounting surface 32. Transmitter diode 112 can be an SFH485-2 and receiver diode 114 can be an SFH203FA, both manufactured by Siemens.

Figure 4:
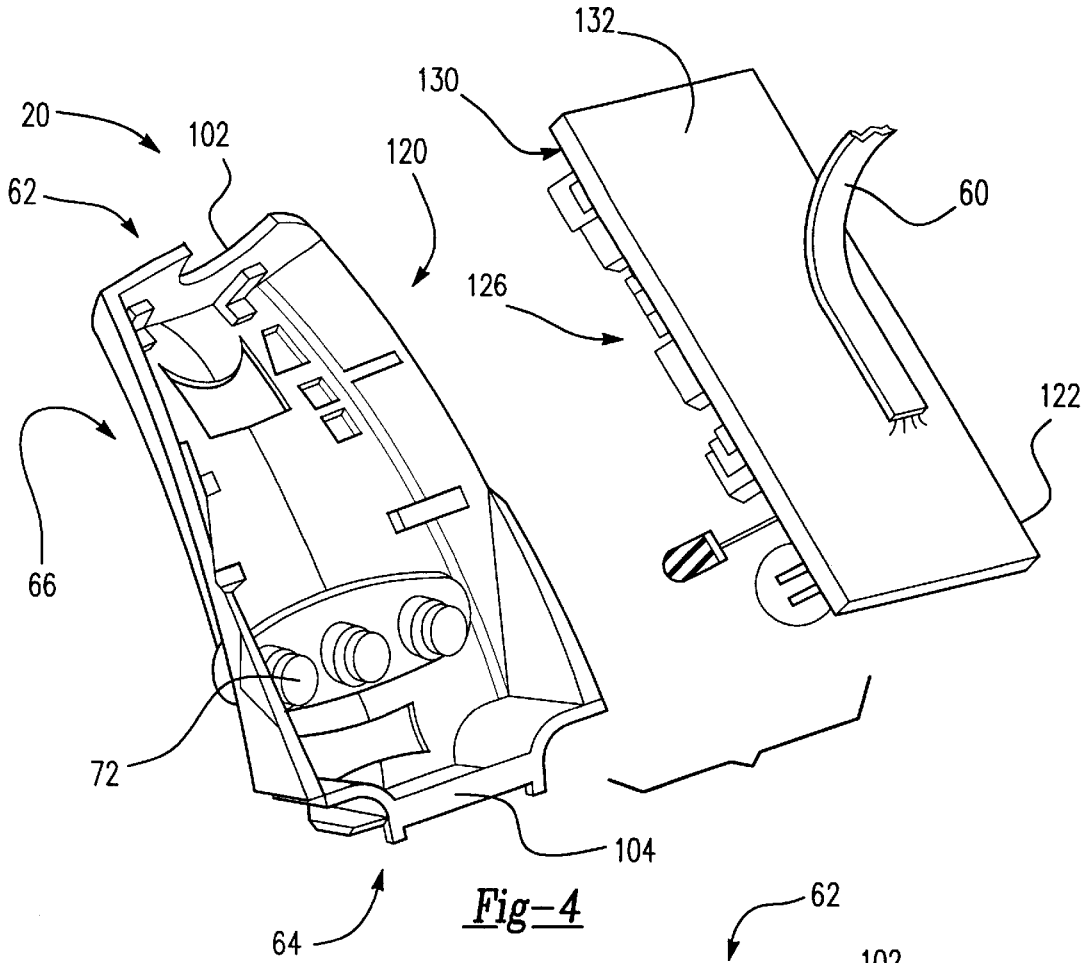
FIG. 4 is an exploded view of the electronics module of the faucet of FIG. 1.
Figure 5:
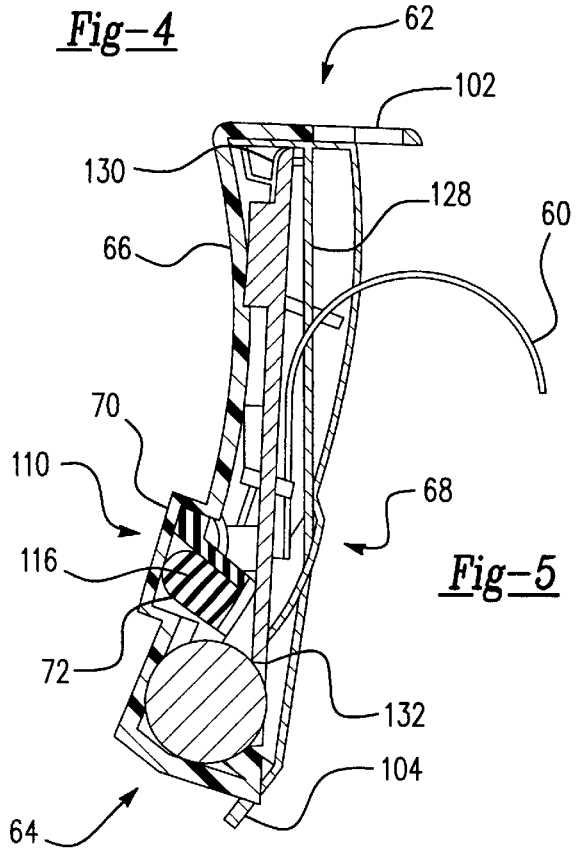
FIG. 5 is a vertical cross-sectional view of the electronics module of FIG. 4.

Turning now to FIG. 4 and the vertical cross-section of FIG. 5, the construction of electronics module 20 will now be described. Module 20 includes an electronics housing 120, a printed circuit board 122, and sensor housing 72. Printed circuit board 122 contains all three diodes 112, 114, 116 thereon, along with a control circuit 126 that will be described further below. Assembly of electronics module 20 involves insertion of printed circuit board 122 into housing 120 with simultaneous insertion of the diodes into sensor housing 72, and then potting of the printed circuit board in place, as indicated at 128 in FIG. 5.

Figure 6:
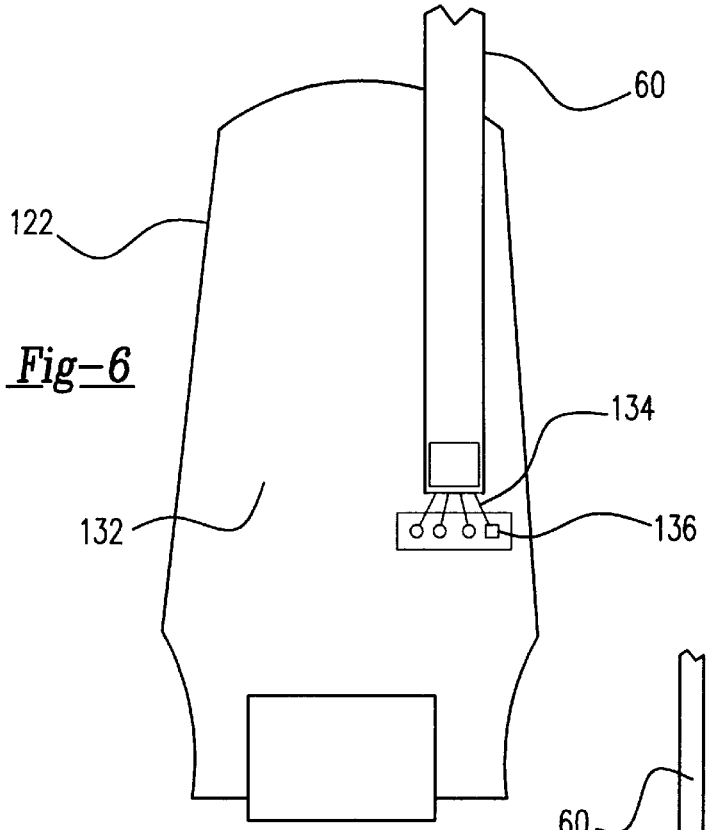
FIG. 6 is a rear view of the printed circuit board used in the electronics module of FIG. 4 showing the battery and solenoid cable connection to the circuit board.
Figure 7:
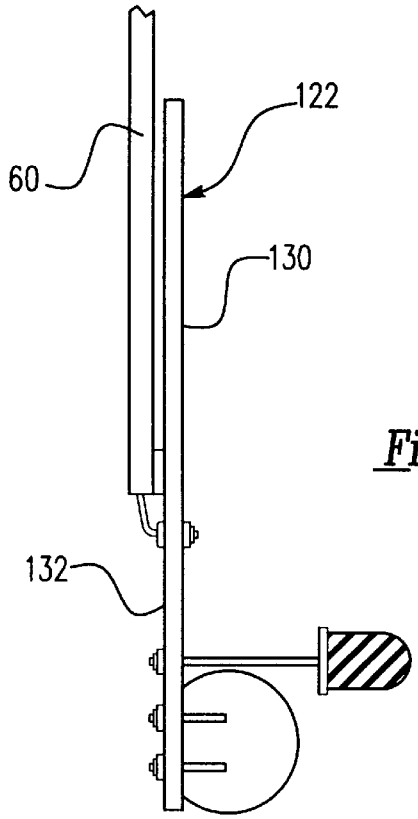
FIG. 7 is a side view of the printed circuit board shown in FIG. 6.
Figure 8:
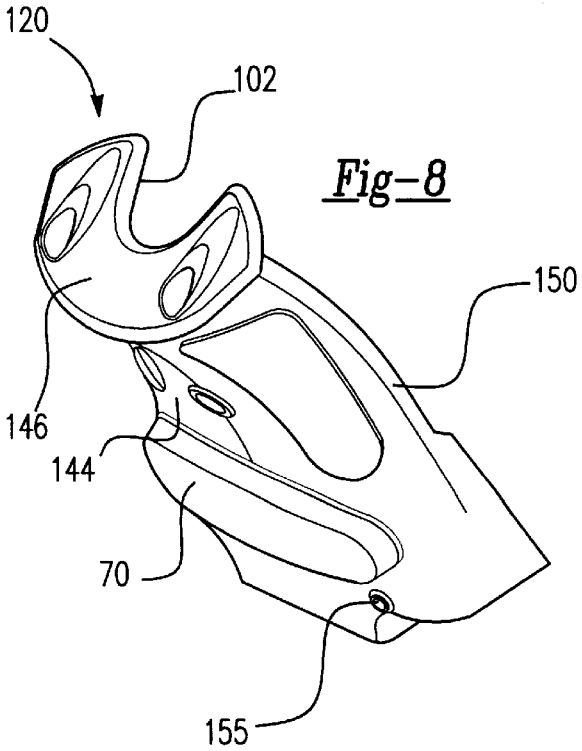
FIG. 8 is a perspective view of the electronics housing used in the electronics module of FIG. 4.
Figure 9:
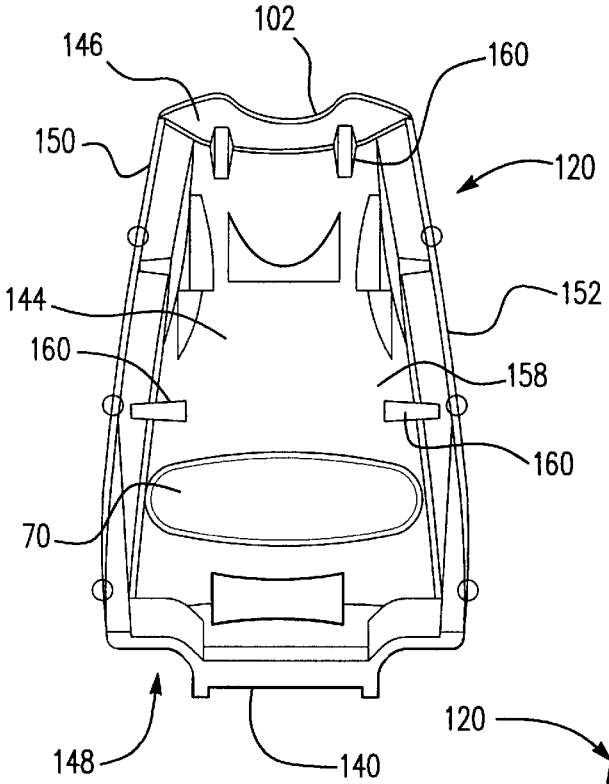
FIG. 9 is a rear view of the electronics housing of FIG. 8.
Figure 10:
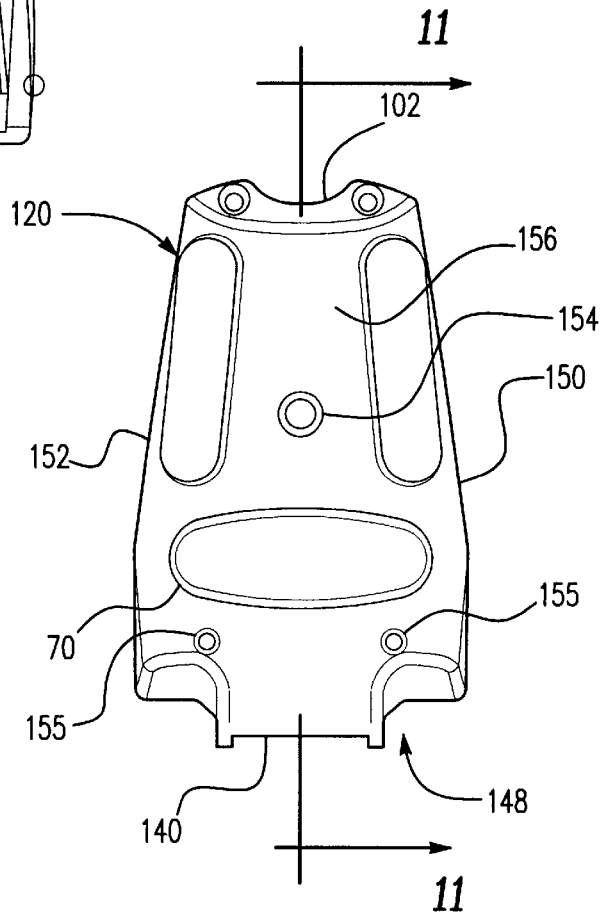
FIG. 10 is a front view of the electronics housing of FIG. 8.
Figure 11:
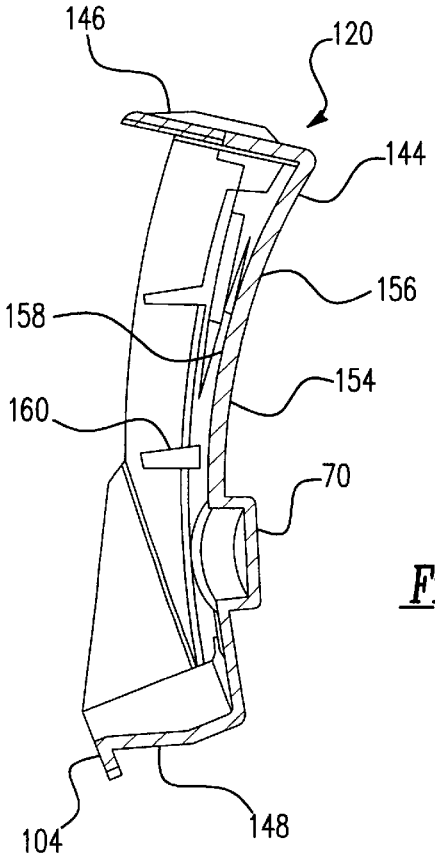
FIG. 11 is a vertical cross-sectional view of the electronics housing taken along the 11—11 line of FIG. 10.

As shown in FIGS. 6 and 7, printed circuit board 122 has a contour designed to fit within electronics housing 120. Circuit board 122 includes a front side 130 upon which the electronic components of control circuit 126 are mounted, and a back side 132 at which electronics cable 60 is attached. As mentioned above, cable 60 is used to provide a connection to battery pack 82 and the solenoid actuator of valve 14. The four wires 134 used for these connections are soldered onto circuit pads 136 on back side 132 of circuit board 122. Cable 60 is bonded to back side 132 to prevent movement of wires 134 that could otherwise cause breakage or disconnection of one or more of the wires.

Referring now to FIGS. 8–11, electronics housing 120 is made of injection molded plastic such as Lexan 141-6124 RTP Color No. SC-52156 (available from GE Plastics) which is transmissive to the infra-red light used by sensor 110 and transmissive to the one or more frequencies of visible light emitted by annunciator LED 116. Electronics housing 120 is used as a support member for printed circuit board 122 and sensor housing 72. It has a front wall 144, a top wall 146, a bottom wall 148, and opposing sides walls 150, 152. These walls together form a containment vessel into which the potting compound can be poured after assembly of the other components of electronics module 20. Front wall 144 includes a central bearing surface 154 at its mid-section which bears against the bearing surface 106 of lower housing 26 when assembled (see FIG. 2). Front wall 144 also includes a pair of lower bearing surfaces 155, each of which bears against a respective one of the two bearing surfaces 108 shown in FIG. 1. These bearing surfaces 154 and 155 comprise individual raised portions of the outer surface 156 of front wall 144. Top wall 146 includes the curved recess 102 which seats the spout tube when assembled. Bottom wall 148 includes the flange 104 that is used to retain the lower part of electronics housing 120 in place against the shank nut 56 when assembled.

Protruding from the inner surface 158 of front wall 144 of electronics housing 120 are a number of standoff supports 160 that are used to space printed circuit board 122 from front wall 144 and to otherwise properly locate it within housing 120. Sensor housing 72 fits securely within the protruding portion 70 of front wall 144. This portion 70 protrudes forwardly by an amount that is selected so that, as shown in FIG. 2, when electronics module 20 is assembled and inserted into spout 16, the front surface of this portion 70 is flush with the outer surface of lower housing 26 to thereby provide a continuous smooth surface on the exterior of spout 16.

Figure 12:
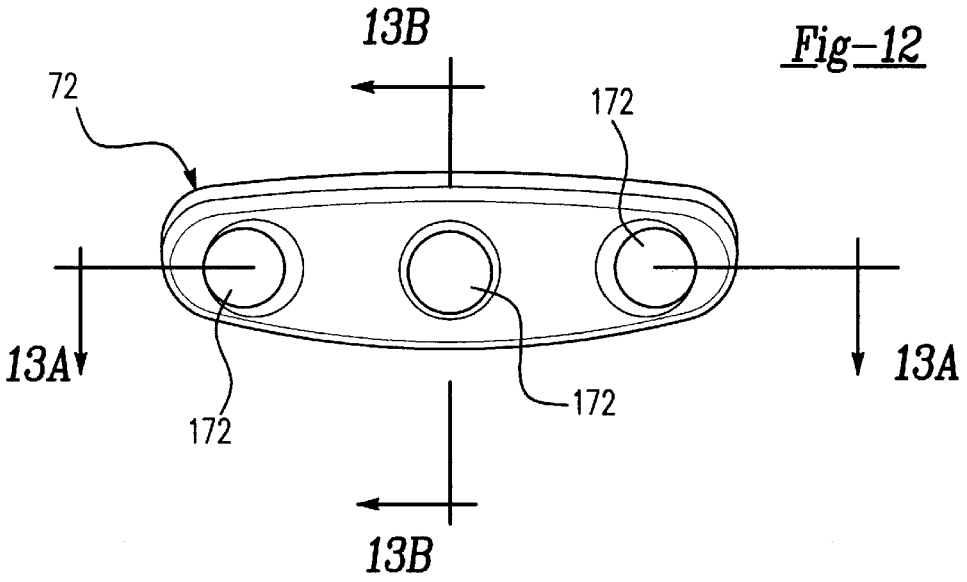
FIG. 12 is a front view of the sensor housing of FIG. 8.
Figure 13A:
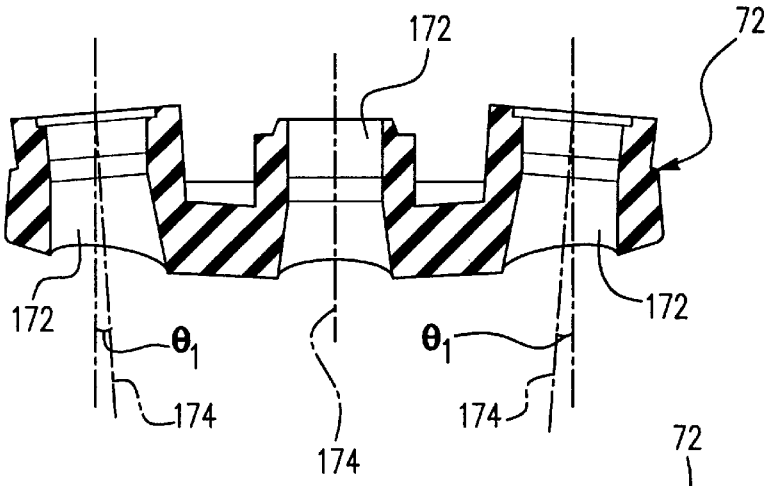
FIG. 13A is a horizontal cross-sectional view of the sensor housing taken along the A—A line of FIG. 12.
Figure 13B:
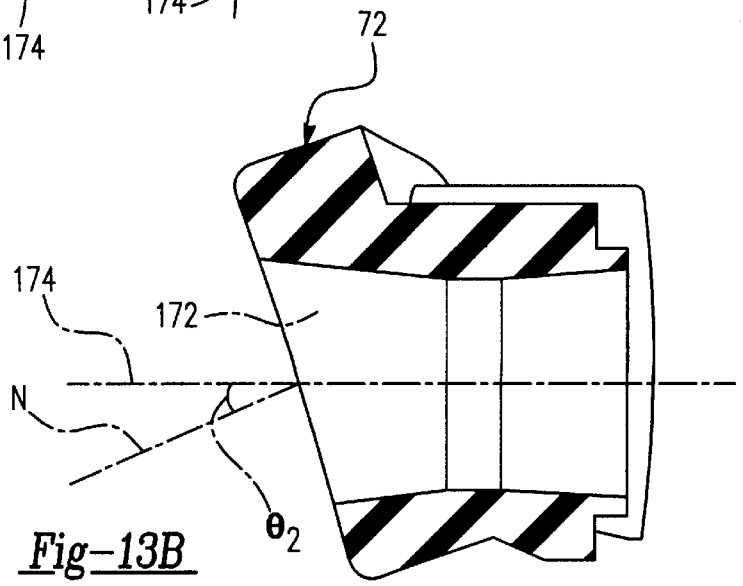
FIG. 13B is a vertical cross-sectional view of the sensor housing taken along the B—B line of FIG. 12.

With additional reference to FIGS. 12, 13A, and 13B, sensor housing 72 is made from black Santoprene 101-73

(available from Advanced Elastomer Systems of Akron, Ohio) or other suitable rubber. Sensor housing 72 includes three spaced chambers 172 that receive the diodes 112, 114, and 116. Each chamber 172 comprises a bore that extends through the sensor housing, with the bore having a cylindrical shape that diverges slightly from a central region of the bore towards both ends of the bore. The orientation of each chamber defines the orientation of the diode that it holds. As shown in FIG. 13A, the slight inward angle of the transmitter and receiver diodes is achieved by orienting the outer chambers 172 inwardly such that their centerlines 174 form an angle $\theta_1$ of approximately five degrees with respect to the centerline 174 of the inner chamber 172. As shown in FIG. 13B, the chambers 172 are oriented such that they are inclined upwardly at an angle $\theta_2$ of approximately five degrees relative to a line N that is normal to the face of sensor housing 72 (and thus normal to the face of the protruding portion 70 of electronics housing 120). Preferably, angle $\theta_2$ is selected such that, when sensor housing 72 is assembled into spout 16, the centerlines 174 are substantially parallel to the base (mounting surface 32) of spout 16.

The inner diameter of each of the chambers 172 is slightly less than the outer diameters of the diodes 112, 114, 116 so that, during assembly, the diodes are press-fit into the chambers. This provides a substantially air and water-tight seal between the diodes and sensor housing 72. Similarly, the outer dimensions of sensor housing 72 are selected such that, when assembled into protruding portion 70, sensor housing 72 seals against the sides of protruding portion 70. Sensor housing 72 thus not only acts as a mounting for the diodes, determining the relative orientation of their fields of view, but also acts as a seal, preventing water or other fluids from leaking into the protruding portion 70 and possibly obstructing the diodes' fields of view. This sealing arrangement is particularly helpful during the potting operation discussed above, since it prevents leakage of potting compound into the protruding portion 70 and, once potted, the diodes are sealed in place not only by sensor housing 72, but also by the potting of the electronics module 20.

Figure 14:
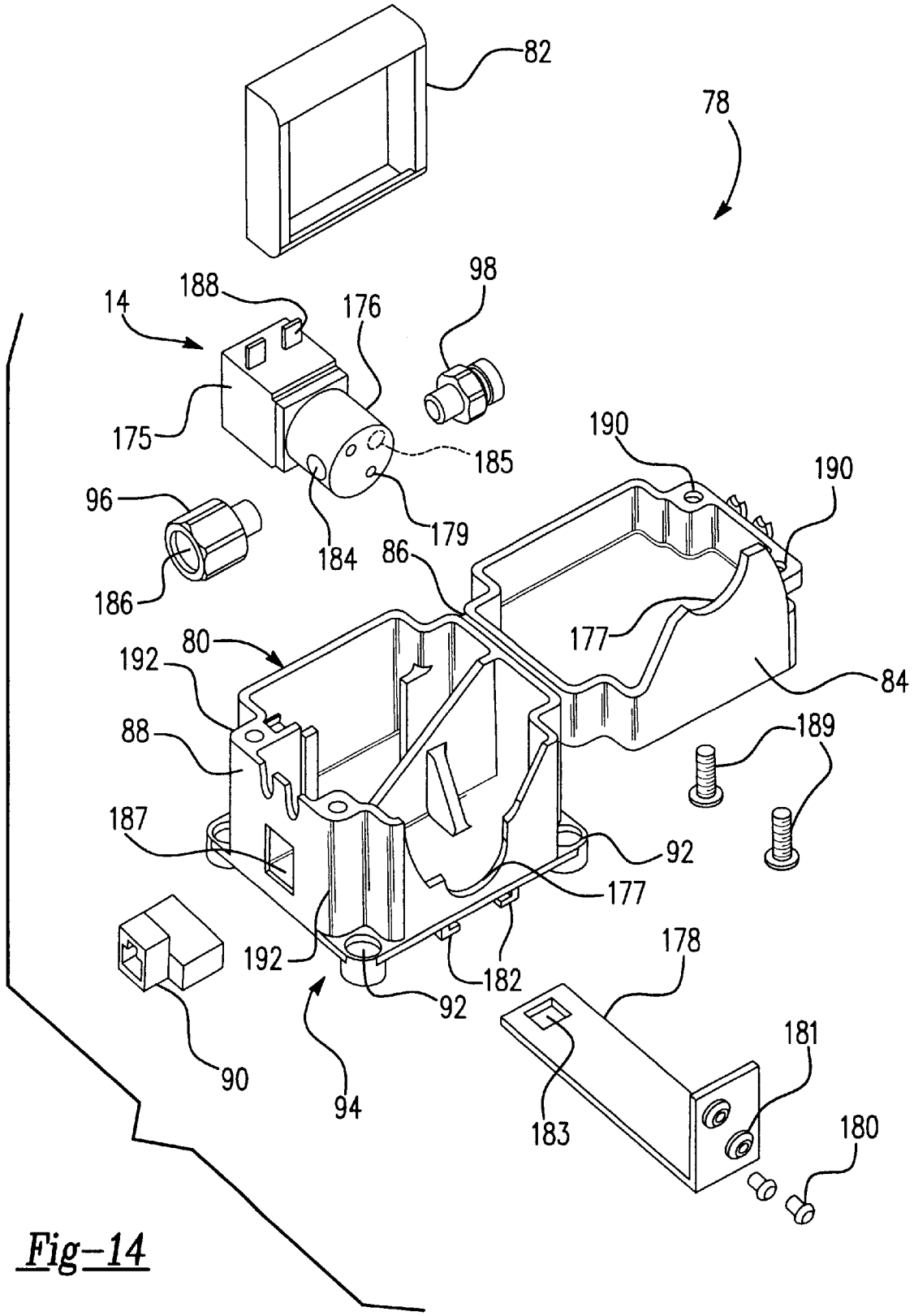
FIG. 14 is an exploded view of the valve assembly used in the electronic faucet of FIG. 1.
Figure 15:
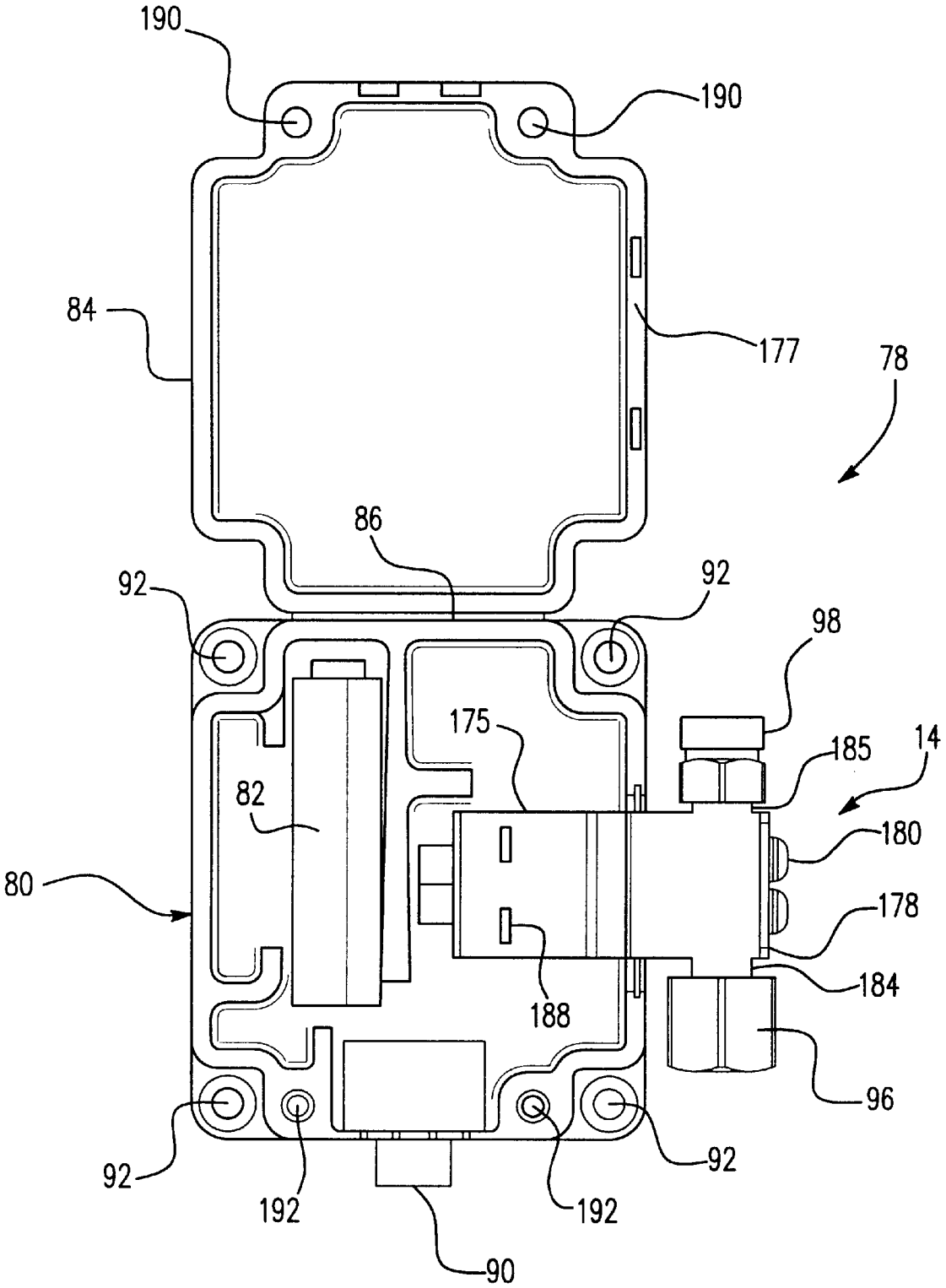
FIG. 15 is a front view of the valve assembly of FIG. 1 with the lid open to show the contents of the valve assembly.

FIGS. 14 and 15 depict further details of valve assembly 78. As discussed above, valve assembly 78 includes a plastic case 80 which holds valve 14, battery pack 82, and socket connector 90. Valve 14 includes a solenoid actuator portion 175 that is located within case 80 and a water valve portion 176 that extends through a recesses 177 in case 80. Valve 14 is held in place using a bracket 178 that is screwed into threaded holes 179 in valve portion 176 using fasteners 180 that extend through clearance holes 181 in bracket 178. The bracket is attached to the rear wall 94 of case 80 using a pair of tabs 182 that run most of the length of rear wall 94. Bracket 178 includes a square opening 183 that snaps over a complementary protrusion (not shown) in rear wall 94 when bracket 178 is slid in between tabs 182 during assembly.

Valve 14 comprises a solenoid actuated valve that can be electrically energized to switch it between an open state in which it permits water flow between its inlet 184 and outlet 185, and a closed state in which it prevents water flow between inlet 184 and outlet 185. The solenoid actuator 175 is a toggle-type actuator, meaning that only momentary energization is needed to switch valve 14 between its open and closed states and that it no further energization is thereafter required to keep it in either state. Preferably, valve 14 is operable using a 6 volt d.c., 50 msec pulse and can withstand line pressures of 150 psi. Valve 14 can be a Series 200 pulse latching solenoid valve, available from Evolutionary Concepts, Inc., of San Dimas, Calif. The inlet connector 96 includes a standard screen 186 to prevent solid objects within the water supply from entering valve 14 and possibly damaging it. In the illustrated embodiment, valve 14 includes a single inlet for receiving supply water at a pre-mixed temperature. Of course, separate hot and cold water inlets could be provided along with a mixing valve to permit the user to select the desired water temperature.

Socket connector 90 is a modular receptacle that extends out of case 80 through an opening 187 in bottom wall 88. It is wired to battery pack 82 and to the terminals 188 on valve 14. Once the components of valve assembly 78 are assembled into case 80, the lid 84 is closed a secured shut with a pair of self-tapping screws 189 that extend through clearance holes 190 in lid 84 and into respective posts 192.

Figure 16:
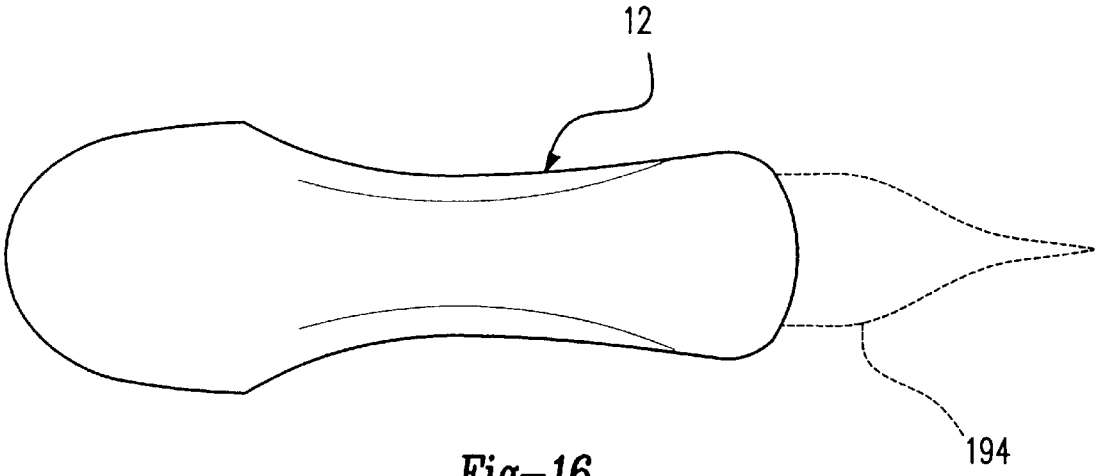
FIG. 16 is a top view showing a typical detection zone when the faucet of FIG. 1 is used in a porcelain sink.
Figure 17:
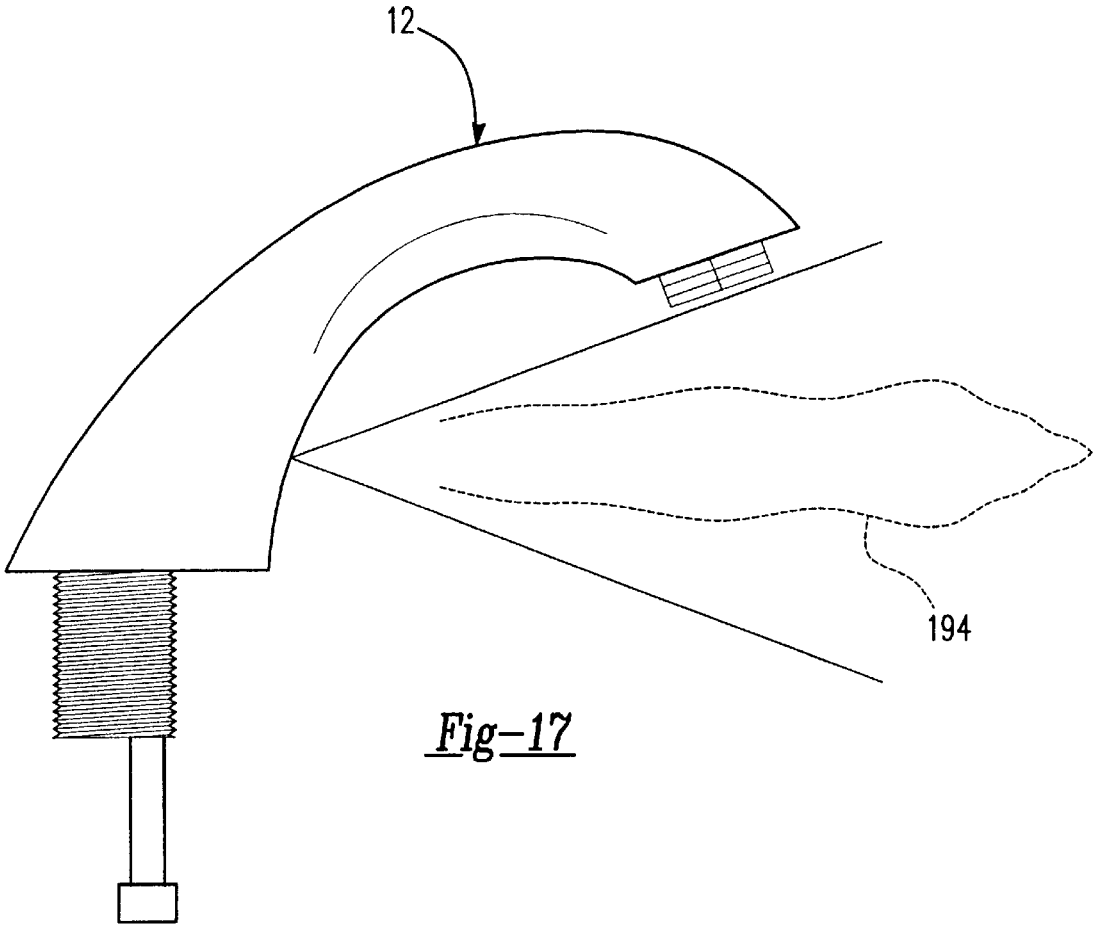
FIG. 17 is a side view of the detection zone shown in FIG. 16.
Figure 18:
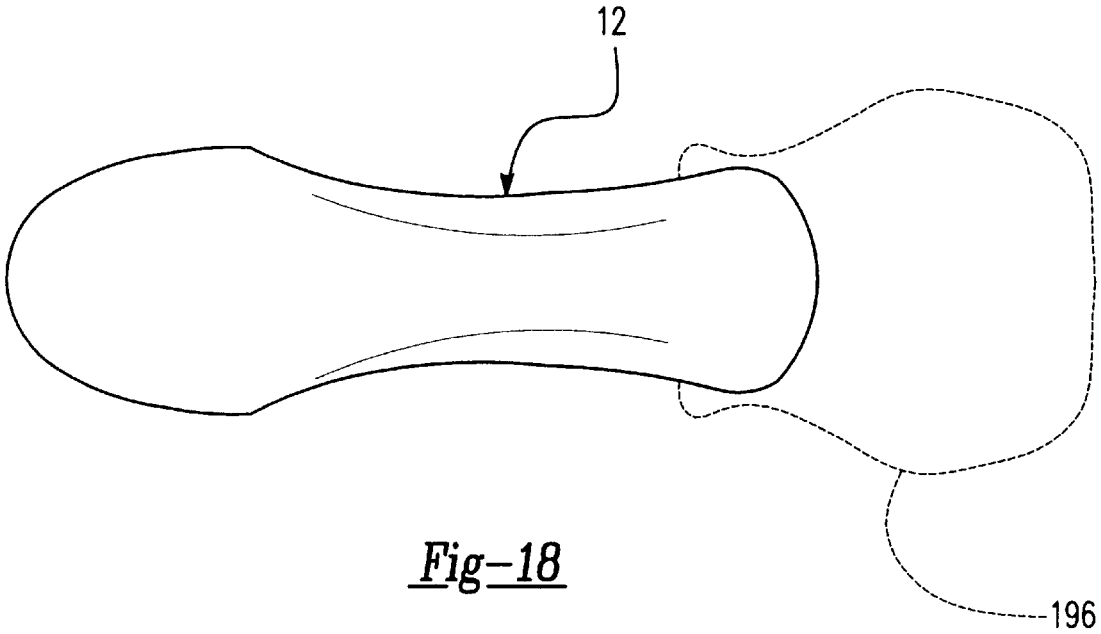
FIG. 18 is a top view showing a typical detection zone when the faucet of FIG. 1 is used in a metal sink.
Figure 19:
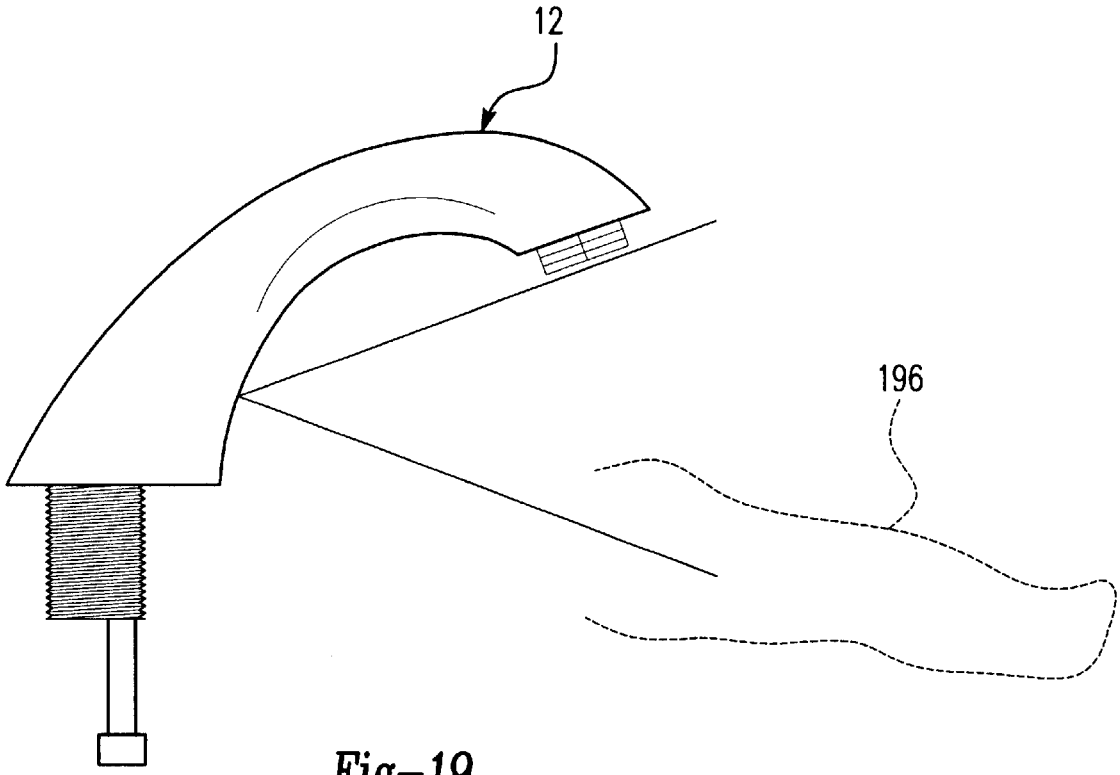
FIG. 19 is a side view of the detection zone shown in FIG. 18.

Turning now to FIGS. 16–19, typical detection zones resulting from the orientation and operation of sensor 110 using control circuit 126 are shown. The detection zone 194 shown in FIGS. 16 and 17 is one that results from installation of faucet 10 on a porcelain sink. The detection zone 196 shown in FIGS. 18 and 19 is one that results from installation of faucet 10 on a metal (e.g., stainless steel) sink. As will be appreciated by a comparison of the two sets of figures, different installations can result in significantly different regions of object detection. This difference is due primarily to the difference in the amount of light reflected by different types of sink surfaces, with metal sinks typically reflecting much more light back to the IR receiver diode than porcelain sinks. Also, the shape of the sink can significantly affect the amount of reflected light detected by the receiver diode. As will now be discussed in connection with the remaining figures, the control circuit 126 of faucet 10 is designed to accommodate these various installations without any degradation in performance.

Figure 20:
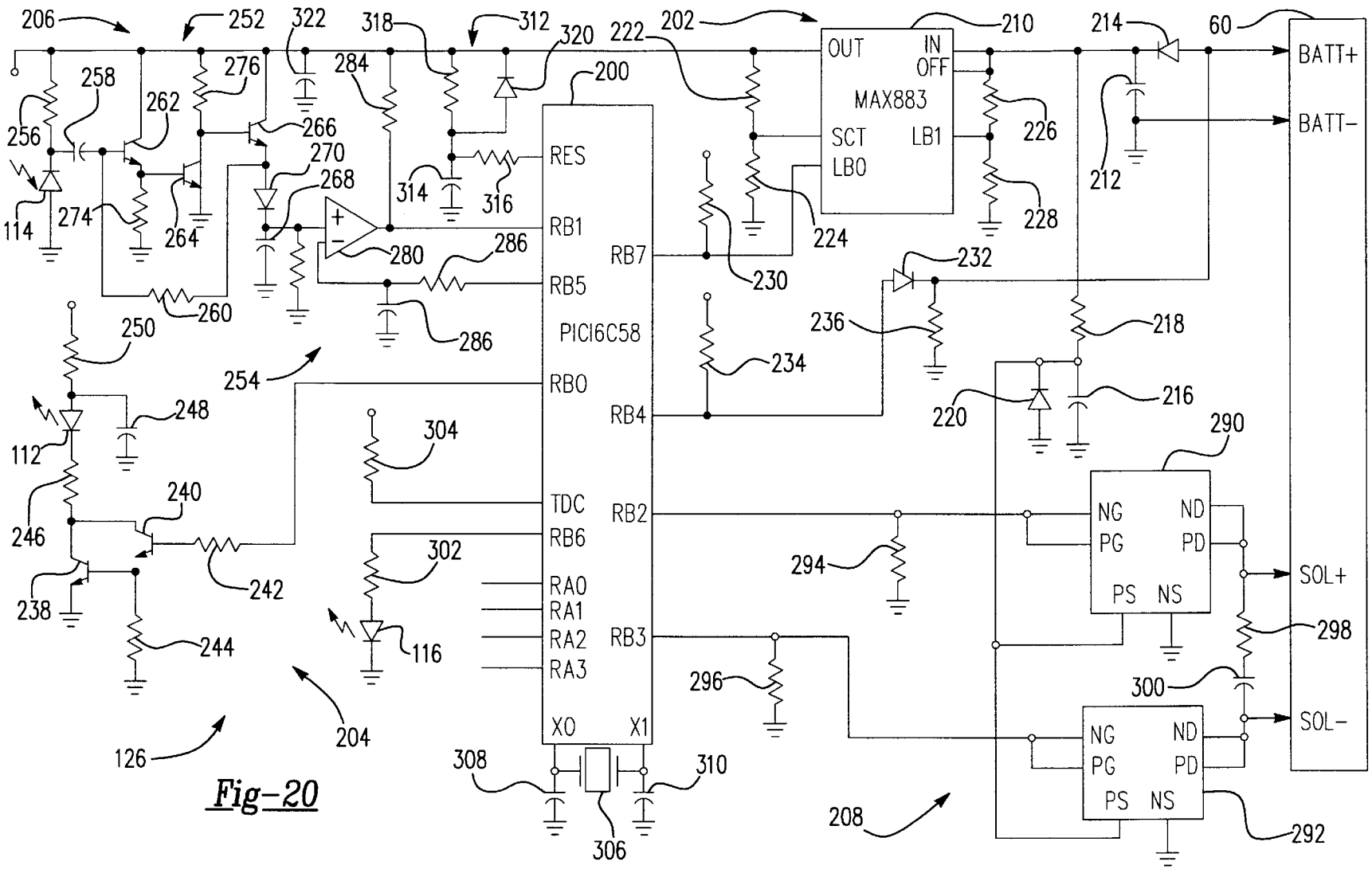
FIG. 20 is a schematic of the electronic control circuit of the faucet of FIG. 1.

FIG. 20 depicts control circuit 126. In general, circuit 126 includes a microprocessor 200, a voltage regulator circuit 202, an IR pulse transmitter circuit 204, an IR detector circuit 206, and a solenoid drive circuit 208. Microprocessor 200 can be a PIC16C58A (manufactured by Microchip Technology, Inc.), which is an 8-bit CMOS RISC processor that includes 2K of on-board ROM and 73 registers of RAM. Stored in the ROM is a control program that, upon execution, performs all of the logic processing necessary to operate faucet 10, including calibration, object detection, and switching of valve 14.

Voltage regulator circuit 202 utilizes a linear voltage regulator to provide a well-regulated 4.1 volts of operating power to microprocessor 200, IR transmitter circuit 204, and IR receiver circuit 206. For this purpose an adjustable regulator 210 can be used, such as a MAX883, manufactured by Maxim Integrated Products of Sunnyvale, Calif. Circuit 202 receives battery power from a pair of pins (BATT+, BATT−) on electrical cable 60. BATT− is connected to the circuit ground and BATT+ is connected to an input filter capacitor 212 via a diode 214 that protects control circuit 126 against a reverse polarity such as might occur from incorrectly installed batteries. A large capacitor 216 is also connected to the BATT+ terminal via diode 214 and a current limiting resistor 218. Capacitor 216 has a capacitance selected such that it stores enough charge to provide momentary operation of both circuit 126 (including microprocessor 200) and solenoid valve 14. As will be discussed further below, this permits the microprocessor to switch valve 14 to the closed state in the event that the battery pack is disconnected while the faucet is running. A zener diode 220 is placed across capacitor 216 to protect the circuit from an overvoltage condition such as could occur from use of the wrong type of batteries.

BATT+ is connected via diode 214 to the supply input of voltage regulator 210. The regulated output is determined by a voltage divider consisting of resistors 222 and 224, which are precision (1% tolerance) resistors. The common node between these resistors is provided as a feedback into the SCT input of regulator 210 and, consequently, the relative resistance values of these resistors determines the output voltage of regulator 210. A second voltage divider consisting of resistors 226 and 228 is provided at the input of regulator 210, with their common node being connected to a low battery detection input (LB1) of regulator 210. The relative values of resistors 226 and 228 determines the input voltage at which regulator 210 changes the logic level on its output LBO to indicate a low battery voltage condition. Preferably, precision resistors are used here as well, with the low battery voltage being set at 4.5 volts. Output LB0 is connected to input RB7 of microprocessor 200, with a pull-up resistor 230 being used to provide the input with a logic one level in the absence of a low-impedance output on LB0.

Microprocessor 200 detects a battery disconnect condition using an input RB4 that is connected via a diode 232 to BATT+. When battery voltage is present, diode 232 will be reversed biased, allowing input RB4 to float to a logic one level due to pull-up resistor 234. When the battery pack is disconnected, diode 232 becomes forward biased and current flows through resistor 234, diode 232, and to ground via a second resistor 236 which has a resistance value that is one-tenth that of pull-up resistor 234. Accordingly, the voltage at RB4 falls to a logic zero level, thereby indicating a battery disconnect condition.

IR pulse transmitter circuit 204 produces pulses of IR light in response to intermittent control pulses from microprocessor 200. Circuit 204 principally comprises LED 112 along with two transistors 238, 240 configured as a Darlington pair using resistors 242, 244. Output RB0 of microprocessor 200 is coupled to the base of the transistor pair, with their collectors being connected to LED 112 via a current limiting resistor 246. A large valued capacitor 248 connected between the cathode of LED 112 and ground is continuously charged via a small valued resistor 250. Microprocessor 200, operating under control of its program, outputs 4–5 $\mu$sec pulses, normally every 300–400 msec, but more often during its object detection tracking routine, as will be discussed below. Each pulse switches on transistors 238, 240 which in turn cause capacitor 248 to discharge through LED 112, thereby producing a pulse of IR light.

Reflected and other IR light is received by IR detector circuit 206 and compared to a setpoint provided by microprocessor 200. Circuit 206 comprises IR sensor diode 114, an amplifier 252, and a comparator stage 254. Sensor diode 114 is connected such that it is maintained in a reverse biased condition via a resistor 256 connected between the anode of diode 114 and the regulated supply voltage rail. In the absence of IR light impinging upon diode 114, it remains non-conductive in the reverse direction and the voltage at its anode rises to that of the supply rail. However, IR light received by diode 114 causes it to conduct in the reverse direction, thereby lowering the voltage at the common node of diode 114 and resistor 256. This node is a.c. coupled to amplifier 252 by a capacitor 258 which, along with resistor 260, filters out all IR light having a frequency less than that corresponding to the 5 $\mu$sec transmitter pulse duration. The first stage of amplifier 252 comprises a transistor 262 that is connected to drive a second stage transistor 264, which in turn drives an inverting transistor 266 that controls charging of a capacitor 268. This capacitor is connected as a peak detector through a diode 270. In the absence of a reflected IR pulse, capacitor 268 discharges slowly through a resistor 272, leaving the voltage at the cathode of diode 270 sufficiently high to switch on transistor 262. This drives current into the base of transistor 264, as well as through an emitter resistor 274, which switches transistor 264 on and pulls the voltage at the gate of transistor 266 down to ground. This switches transistor 266 off, thereby preventing charging of capacitor 268 via transistor 266 and diode 270. When a pulse is received by diode 114, it conducts, pulling the voltage at the gate of transistor 262 down and thereby switching both transistors 262 and 264 off. Consequently, transistor 266 switches on due to current flow through a pull-up resistor 276 and, as a result, charges capacitor 268. Because the amount of current conducted by diode 114 is dependent upon the strength of the received IR pulse and because of the amplification provided by transistors 262 and 264, the voltage on capacitor 268 will be proportional to the strength of the received IR pulse.

Comparator stage 254 is used to provide microprocessor 200 with a binary signal indicative of whether the signal received from diode 114, as represented by the voltage on capacitor 268, is greater than or less than the setpoint provided by microprocessor 200. Comparator stage 254 principally comprises a comparator 280 and a capacitor 282 that stores a voltage representative of the setpoint. The non-inverting input of comparator 280 is connected to capacitor 268, while the inverting input is connected to capacitor 282. The output of comparator 280 is connected to an input RB1 of microprocessor 200 along with a pull-up resistor 284. Capacitor 282 is charged by microprocessor 200 via a tri-state output RB5 and a resistor 286. As will be appreciated by those skilled in the art, the voltage on capacitor 282 is determined by the time constant of capacitor 282 and resistor 286, as well as by the length of time that the output RB5 of microprocessor 200 is held at a logic one level. The length of time capacitor 282 is charged is determined by the microprocessor's control program. Once the capacitor is charge to the desired voltage, the output RB5 is changed to a high impedance state. Discharging of capacitor 282 is done similarly by switching output RB5 to a low impedance, logical zero level for an amount of time sufficient to discharge capacitor 282 via resistor 286. Whenever the voltage on capacitor 268 exceeds that on capacitor 282, comparator 280 outputs a logic one level, thereby indicating that the received IR pulse was greater than the setpoint. Conversely, a voltage on capacitor 268 that is below that on capacitor 282 results in a logic zero level, thereby indicating that the received IR pulse, if any, was less than the setpoint.

Solenoid drive circuit 208 permits microprocessor 200 to switch valve 14 between its open and closed states. Drive circuit 208 utilizes two complementary MOSFET drivers 290, 292, each of which include an n-channel and p-channel MOSFET connected in a push-pull configuration with their drains connected together to one of the two solenoid output terminals, SOL+ and SOL−. Thus, drivers 290 and 292 together form an H-bridge drive topology for solenoid valve 14. The source connections of the p-channel MOSFETs are connected together to capacitor 216 which, as mentioned above, provides the stored charge needed to activate solenoid valve 14. Control of drive circuit 208 is by way of two outputs RB2 and RB3 of microprocessor 200, each of which includes a pull-down resistor 294, 296. Normally, these outputs are at a logic zero level, which turns off the lower two n-channel transistors and turns on the upper two p-channel transistors of the H-bridge. This results in the battery voltage appearing at both the SOL+ and SOL− outputs. To switch valve 14 to the closed position, microprocessor 200 provides a 50 msec active high pulse on output RB2. This switches off the p-channel MOSFET in driver 290 and turns on the n-channel MOSFET in driver 290, thereby pulling SOL+ to ground. As a result, capacitor 216 discharges through driver 292, the solenoid coil in valve 14, and then to ground through driver 290. Conversely, to switch valve 14 to the open position, output RB3 is provided with a 50 msec pulse which turns off the p-channel MOSFET in driver 292, turns on the n-channel MOSFET in that same driver, and therefore discharges capacitor 216 through driver 290, the solenoid coil, and then driver 292. A snubber comprising a resistor 298 and capacitor 300 is connected across SOL+ and SOL− to protect against transient spikes resulting from current flow through the solenoid coil during switching of the MOSFETs. Drivers 290 and 292 can each be a MMDF2C01HD, manufactured by Motorola.

Several other features of control circuit 126 are worth noting. Annunciator LED 116 is controlled by an output RB6 of microprocessor 200. When it is set high under control of the program, output RB6 drives LED 116 by way of a current limiting resistor 302. Clock input TDC (T0CK1) is held at a logic one level via a pull-up resistor 304. Microprocessor 200 is clocked at 4 MHz by an oscillator comprising a crystal 306 and two capacitors 308, 310 connected in a conventional manner. A reset circuit 312 provides a proper reset of microprocessor 200 upon power-up. It includes a capacitor 314 that is connected via a resistor 316 to the microprocessor's reset input (RES) along with a charging resistor 318 that is connected between the supply rail and capacitor 314. Upon power-up, capacitor 314 holds the voltage at the RES input low for a short time, thereby allowing the supply voltage time to reach its normal 4.1 volts while preventing microprocessor from beginning operation. Once capacitor 314 charges to a logic one level, microprocessor 200 begins operation, automatically running its control program. A diode 320 permits capacitor 314 to quickly discharge through the supply rail. Finally, a filter capacitor 322 can be connected between the supply rail and ground to help protect the circuit against transients.

Figure 21:
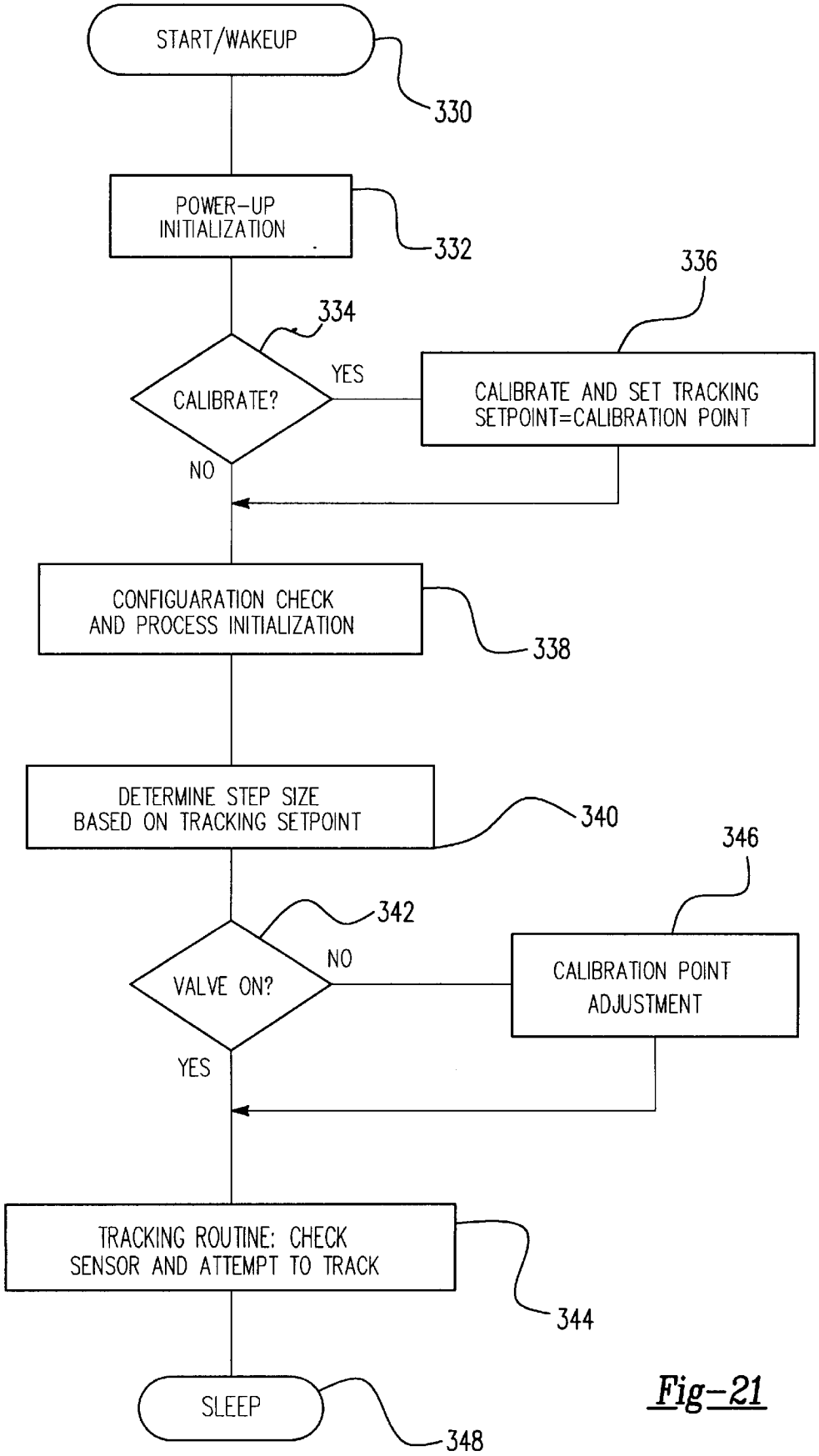
FIG. 21 is a flow chart depicting an overview of the program used in the control circuit of FIG. 20.

Turning now to FIG. 21, there is shown an overview of the control program used by microprocessor 200 for object detection using sensor 110 and for controlling valve 14. In general, the program runs an object detection routine approximately three times a second to periodically check for the presence of an object in front of the faucet. The object detection routine is a tracking process that involves sending sequential pulses of IR light and determining whether the strength of the reflected light is significantly above or below a setpoint. The setpoint is initially set equal to a calibration point that represents a background reading of the reflected IR light. The program thus provides a window about the setpoint and attempts to track the sensor signal within this window. This tracking is accomplished by iteratively adjusting the setpoint towards one of the window boundaries, each time checking to see if the setpoint has either tracked the sensor signal or has reached a boundary of the window without successfully tracking the sensor signal. If the setpoint is unable to track the sensor signal, the valve 14 is switched on. Once the strength of the reflected IR light falls back to within a range of values about the calibration point for several iterations of the tracking routine, the valve is switched back off and the setpoint is reset to the stored calibration point. During periods of inactivity (i.e., where no object is detected for many successive cycles through the tracking routine), the stored calibration point is adjusted incrementally up or down based upon a running average of the most recent setpoint values. After each execution of the object detection routine, the microprocessor is placed into a low-quiescent current (sleep) mode to conserve battery power during the one-third of a second intervals between instances of the object detection routine.

The process begins at start block 330 where the microprocessor either powers up (due to connection of the battery pack) or wakes up from the sleep mode. The microprocessor automatically begins operation of the control program that is stored in the on-board memory. The first step is at block 332 where the program performs a power-up initialization routine. If the microprocessor has been fully powered down due to, for example, a battery disconnect, then upon power-up the initialization routine of block 332 handles such things as flag, register, and port definitions and initializations, as well as resetting of the microprocessor's watch dog timer. If the microprocessor is being woken up from its sleep mode, the previous flag, register, and port definitions are still applicable, and microprocessor need only carry out such tasks as initializing its I/O ports and setting the watch dog timer. At block 334, a decision is made whether to calibrate the faucet. This is done whenever the microprocessor is being powered up after a battery disconnection and whenever the water flow is shut off due to expiration of an Obstruction Timer, as will be described further below. If calibration is needed, the process moves to block 336 where a calibration routine is executed to determine a new calibration point and to initialize an adjustable tracking setpoint that will be used in the tracking routine. The calibration routine will be described below in connection with FIG. 22. Regardless of whether calibration is needed, the program will move to block 338 where it performs a configuration check and process initialization, which, as will be explained in connection with FIG. 24, essentially comprises a check on the status of the system along with an initial setup of the faucet control process.

Program flow then moves to block 340, where the setpoint adjustment, or tracking step size, is determined. As will be discussed further below, the setpoint adjustment is used to adjust the tracking setpoint toward one of the two window boundaries during the iterative tracking process. The size of the adjustment (i.e., the step size) is preferably calculated based upon the setpoint itself so that the step size is proportional to the setpoint value. In the preferred embodiment, the tracking setpoint and calibration point are represented within the microprocessor as 8-bit binary numbers and the step size can be determined by performing an integer division of the setpoint by some number (e.g., 32), and then adding a small offset (e.g., 2). As will be discussed in connection with tracking routine, a second step size can also be determined, with the different step sizes being used to provide a setpoint adjustment that varies as the tracking routine proceeds.

After the setpoint adjustment has been determined, a check is made at block 342 to determine whether valve 14 is in its open state. As will be appreciated, this check can be accomplished simply by checking the status of a flag that is used to indicate the state of the valve. If the valve is on, then flow moves to block 344, where the object detection (tracking) routine is executed. If at block 342, the valve is off, then flow moves to block 346 for a calibration point adjustment routine that makes small incremental adjustments to the stored calibration point, following which the flow moves to block 344. The calibration point adjustment 346 and tracking routine 344 will be discussed in greater detail below in connection with FIGS. 24–27. After tracking, the process moves to block 348 where it enters the sleep mode.

Figure 22:
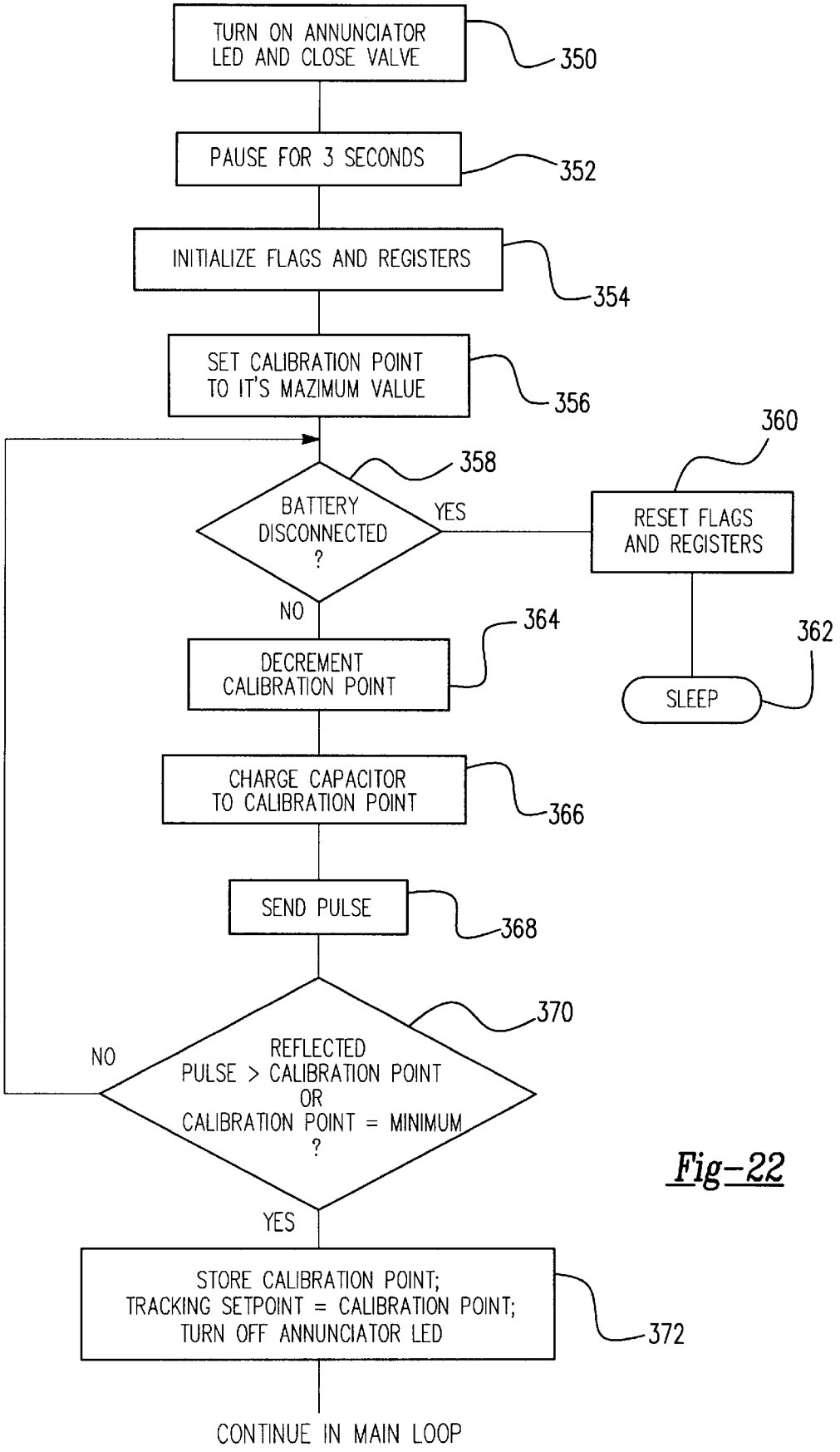
FIG. 22 is a flow chart depicting the calibration routine used in the control program.

Referring now to FIG. 22, the calibration routine will be described. As indicated at block 350, the first step is to turn on the annunciator LED 116 and switch the valve 14 to the closed position to make certain that it is off. The steady illumination of the annunciator light is used to indicate that the faucet is in its calibration mode. Next, the program takes a brief pause of about three seconds, as indicated at block 352. While this pause may not be necessary when calibrating at initial power-up, it is useful when re-calibrating after the water flow has been shut off in response to expiration of the Obstruction Timer. The next step at block 354 is to initialize the various flags and registers that are used to keep track of variables and the status of various operating conditions of the circuit. Variables can includes such things as the Obstruction Timer, the Off Delay Counter, and the number of valve openings. Status flags can include such things as valve position (open or closed) and battery state (normal or low voltage).

After initialization, the program moves to block 356 where the calibration point determination process begins. In general, this process involves setting the calibration point at a pre-selected maximum value and then executing a loop in which it is decremented one step at a time until it falls below the signal received from the sensor. Once that occurs, the calibration point will represent a background reading; that is, it will represent the signal received from the sensor in the absence of a detected object. The first step in this process is to set the calibration point at some selected maximum value (e.g., 255). Then, to guard against battery disconnection during the calibration routine, a check is made at block 358 to determine if the battery pack is disconnected. If so, the process moves to block 360 where the appropriate flags and registers are reset, following which microprocessor 200 is put into its low quiescent current sleep mode, as indicated at block 362. Referring now also to FIG. 20, these steps are possible notwithstanding that the battery pack has been disconnected, because capacitor 216 stores sufficient charge from the battery pack to provide continued operation for a short period of time after disconnection.

If, back at block 358, the battery pack was connected, then flow moves to block 364, where the calibration point is decremented by one. Then, at block 366, capacitor 282 is charge to a voltage representing the current value of the calibration point. This is accomplished by first discharging capacitor 282 so that it is at a known value (zero volts), and then charging it to a voltage that corresponds to the calibration point. In particular, capacitor 282 can be charged to an appropriate voltage by using the value of the calibration point to determine the length of time that the capacitor is charged, with the range of values of the calibration point (e.g., 0–255) being scaled to the range of voltages to which the capacitor can be charged (e.g., 0–4 volts). Of course, some maximum value less than 255 (e.g., 200) can be used as the upper limit for the calibration point, in which case the actual range used (e.g., 0–200) can be scaled to the range of possible capacitor voltages. Similarly, a lower limit other than zero could be used as well. The values of capacitor 282 and resistor 286 can be selected in accordance with the length of the microprocessor's instruction cycle so that charging can be accomplished simply by loading the calibration point value into a counter and decrementing the counter to zero while the microprocessor's output pin RB5 is held high.

Once the capacitor is charged, the program moves to block 368 where the IR transmitter LED 112 is energized with a 4 $\mu$sec pulse and the reflected light is sensed by the IR receiver 114, which provides a signal to comparator 280 indicative of the strength of the received light, as discussed above in connection with FIG. 20. Then, at block 370, comparator 280 is used to determine whether the signal from receiver 114 is greater than the calibration point (i.e., greater than the charge stored on capacitor 282) or, in the alternative, whether the calibration point has been decremented down to some selected minimum value. If neither of these conditions are true, then the process loops back to block 358 to perform another iteration in which the calibration point is decremented, another IR pulse is sent, and the reflected light is received and compared to the calibration point. This loop will continue until the calibration point falls just below the reflected light, at which point the process moves to block 372 where the calibration routine finishes up by storing the calibration point, setting the tracking setpoint equal to the calibration point, and turning off the annunciator LED. As will be discussed in connection with FIG. 25, the tracking setpoint is an adjustable setpoint that is used to track changes in the signal from IR receiver 114. Finally, the program returns to continue in the main loop of FIG. 21.

Figure 23:
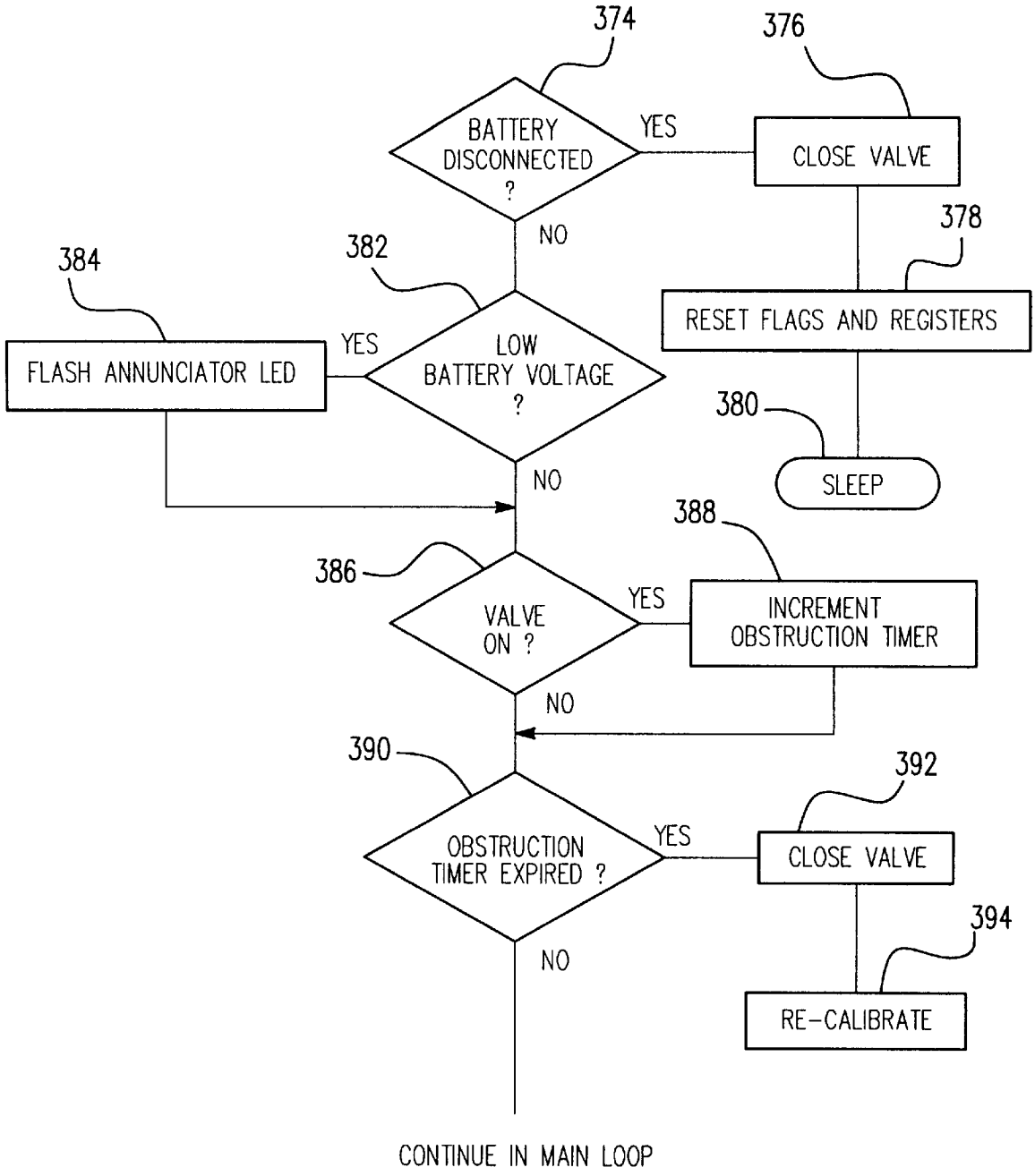
FIG. 23 is a flow chart depicting the configuration check and process initialization and routine used in the control program.

With reference now to FIG. 23, the configuration check and process initialization routine will now be described. At block 374, a check is made to determine if the battery pack has been disconnected. If so, the process moves to block 376 where the valve is switched to its closed state to make sure that it is turned off before operating power (stored on capacitor 216) is lost. Then, the appropriate flags and registers are reset, as indicated at block 378, before going into sleep mode at block 380. If, at block 374, the battery pack had not been disconnected, then the process moves to block 382 where a check is made to determine if there is a low battery voltage condition. If so, then annunciator LED 116 is flashed at ten second intervals, as indicated at block 384. To provide two levels of warning, LED 116 can be flashed at a slow rate (every ten seconds) when the low battery condition is first detected, and then, after the valve has been cycled open and shut a certain number of times while in the low voltage condition, the LED can be flashed at a faster rate (every two seconds) to signal impending battery failure. The process then moves from either block 382 or 384 to block 386 where a check is made to determine if the valve is in its open state. If it is closed, the program continues in its main loop of FIG. 21. If the valve is open, then the Obstruction Timer is incremented at block 388, following which it is checked at block 390 to determine if it has expired. If so, the program moves to blocks 392 and 394 where the valve is closed and a recalibration is run using the routine of FIG. 22.

Figure 24:
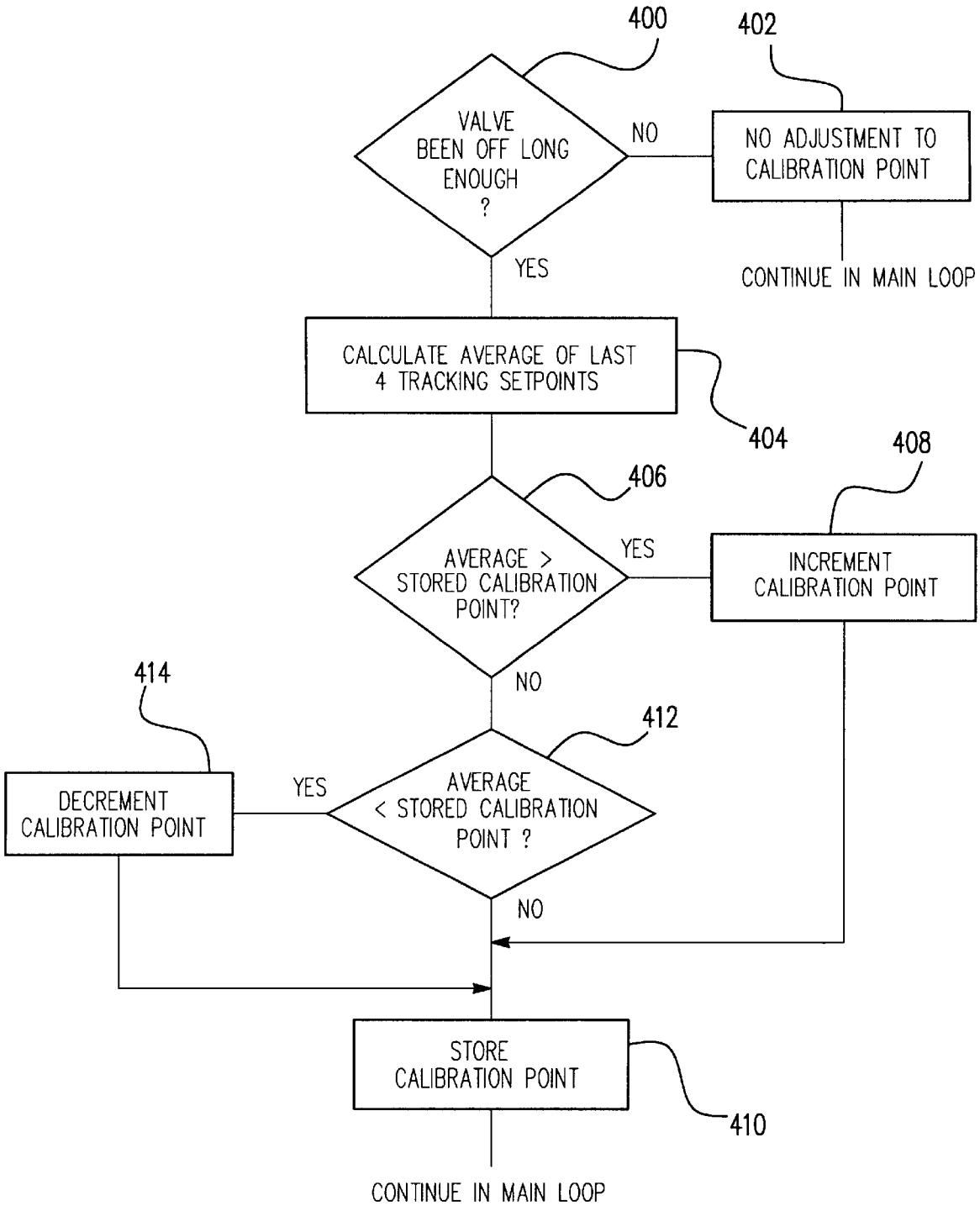
FIG. 24 is a flow chart depicting the calibration point adjustment routine used in the control program.

Turning now to FIG. 24, there is shown the calibration point adjustment routine. In general, this routine involves using a running average of the four most recent values of the tracking setpoint to determine whether the stored calibration point should be incrementally adjusted up or down. As will be described further below, these setpoints are stored at the end of each iteration through the tracking routine. The calibration point adjustment routine begins at block 400 where a check is made to determine if the valve has been in its closed state for the last four iterations through the tracking routine. This prevents the routine from adjusting the calibration point based on tracking setpoints that do not represent a background reading (i.e., tracking setpoints that were used while the water was flowing). If the valve has not been off for enough iterations of the tracking routine, then no adjustment to the calibration point is made, as indicated at block 402, and the program continues in its main loop.

If the valve has been off during the last four iterations through the tracking routine, then the program moves to block 404 where the average of the last four tracking setpoints is calculated. Then, this average is compared to the stored calibration point, as indicated at block 406. If the average is greater than the calibration point, then the calibration point is incremented at block 408 and the new value is stored at block 410, following which the program continues in its main loop. If, at block 406, the average is not greater than the calibration point and, at block 412, is found to be less than the calibration point, then the program moves to block 414 where the calibration point is decremented before being stored at block 410. Thus, this routine provides a slow adjustment to the calibration point based upon a running average of the most recent background readings.

Referring next to FIG. 25, the tracking routine will now be described. In general, the tracking routine determines whether the signal from the IR receiver is above or below the tracking setpoint and then makes limited adjustments to the setpoint in a direction towards the signal in an attempt to track it. If the setpoint is not adjusted past the signal after two attempts, then the routine is unable to track the signal, meaning that it is outside the boundaries of a window centered about the starting value of the setpoint. The tracking routine begins at block 416 where a 4 $\mu$sec IR pulse is sent into the region of space in front of faucet 10. The reflected light is sensed by the IR receiver and, at block 418, is compared to the starting setpoint. As discussed above, the comparison of the signal from the IR receiver with the setpoint is accomplished by charging capacitor 282 to a voltage dependent on the value of the setpoint and then using comparator 280 to provide a binary signal to microprocessor 200 indicative of whether the sensor signal is above or below the setpoint. Also, while the setpoint is initially set equal to the calibration point during the calibration routine, it is not reset to that value after each iteration of the tracking routine, but only after the water flow is shut off or as a part of a re-calibration. Thus, the starting setpoint for any one iteration of the tracking routine may simply be the value that it held at the end of the last iteration.

If the signal from the sensor is above the tracking setpoint, then the program moves to block 420 where a check is made to determine if the valve is in its open state. If so, and if at block 422 the last iteration (if any) of the tracking routine was successful, then the program moves to block 424 where a relatively large increase is made to the tracking setpoint. This has the effect of increasing the window around the starting setpoint to accommodate the greater reflected signal variation expected during water flow. After this large adjustment, the process moves to block 426 where a small adjustment is made to the setpoint using the adjustment size determine at block 340 of FIG. 21. Also, if at block 420, the valve was in its closed state, then the program moves directly to block 426. After the increase to the tracking setpoint, a check is made at block 428 to determine if the setpoint has been adjusted past its upper limit (e.g., the maximum value that the calibration point was initially set to during calibration). If so, then the setpoint is set equal to that upper limit. Then, at block 430, another IR pulse is sent and the reflected light is used by the IR receiver to generate an updated sensor signal. This signal is compared to the adjusted setpoint at block 432 to determine if it is above the adjusted setpoint. If not; that is, if the signal is between the current value of the setpoint and its previous value, then the tracking was successful, as indicated at block 434. As will be discussed further below, this success indicates that the object may no longer be present. If the signal is still above the setpoint even after being adjusted, then the process moves to block 436 where a check is made to determine if the limited adjustment to the tracking setpoint has been made twice. This causes the program to loop through blocks 424–432 a second time in a further attempt to track the signal. The small increase made at block 426 can be the same during each loop or can be increased or reduced the second time through. If, after the second iteration through the loop, the sensor signal at block 432 is not above the current value of the setpoint, then tracking was successful. If, instead, the sensor signal is still above the setpoint (which has now been increased at least twice), then the tracking is considered unsuccessful, as indicated at block 438, and the presence of an object in front of faucet 10 is therefore assumed. As will be appreciated from the foregoing discussion, the size of the window is determined by the size of the adjustments made to the setpoint and the window is larger when the valve is open than when it is closed.

As discussed previously, certain installations of faucet 10 may result in a background reading that is sufficiently high that the presence of an object, such as a user's hands, may actually decrease the amount of reflected IR light. The tracking routine accounts for this possibility by not just attempting to track increases in reflected light, but decreases as well. Thus, if back at block 418, the signal from the receiver was less than the tracking setpoint, then the program moves to block 440 where the same essential adjustment routine as has been described in connection with blocks 420–438 is carried out. In particular, the state of the valve is checked at block 440. If it is on and if, at block 442, the last iteration through the tracking routine was successful, then at block 444 a relatively large decrease is made to the tracking setpoint to account for the effects of the water stream. Otherwise, flow moves directly to block 446 where a small decrease is made using the adjustment step size determined earlier. Then, at block 448 an IR pulse is sent and the reflected light detected. If, at block 450, the signal from the sensor is now greater than the adjusted setpoint then the tracking was successful, as indicated at block 434. If the signal is still less than the setpoint, then block 452 forces another loop through blocks 446–450, following which a final determination is made as to whether or not the tracking was successful. Thus, it will be appreciated that the tracking routine of FIG. 25 provides a window on either side of the starting setpoint outside of which variations of the sensor signal are assumed to be indicative of the presence of an object in front of the faucet.

Figure 26:
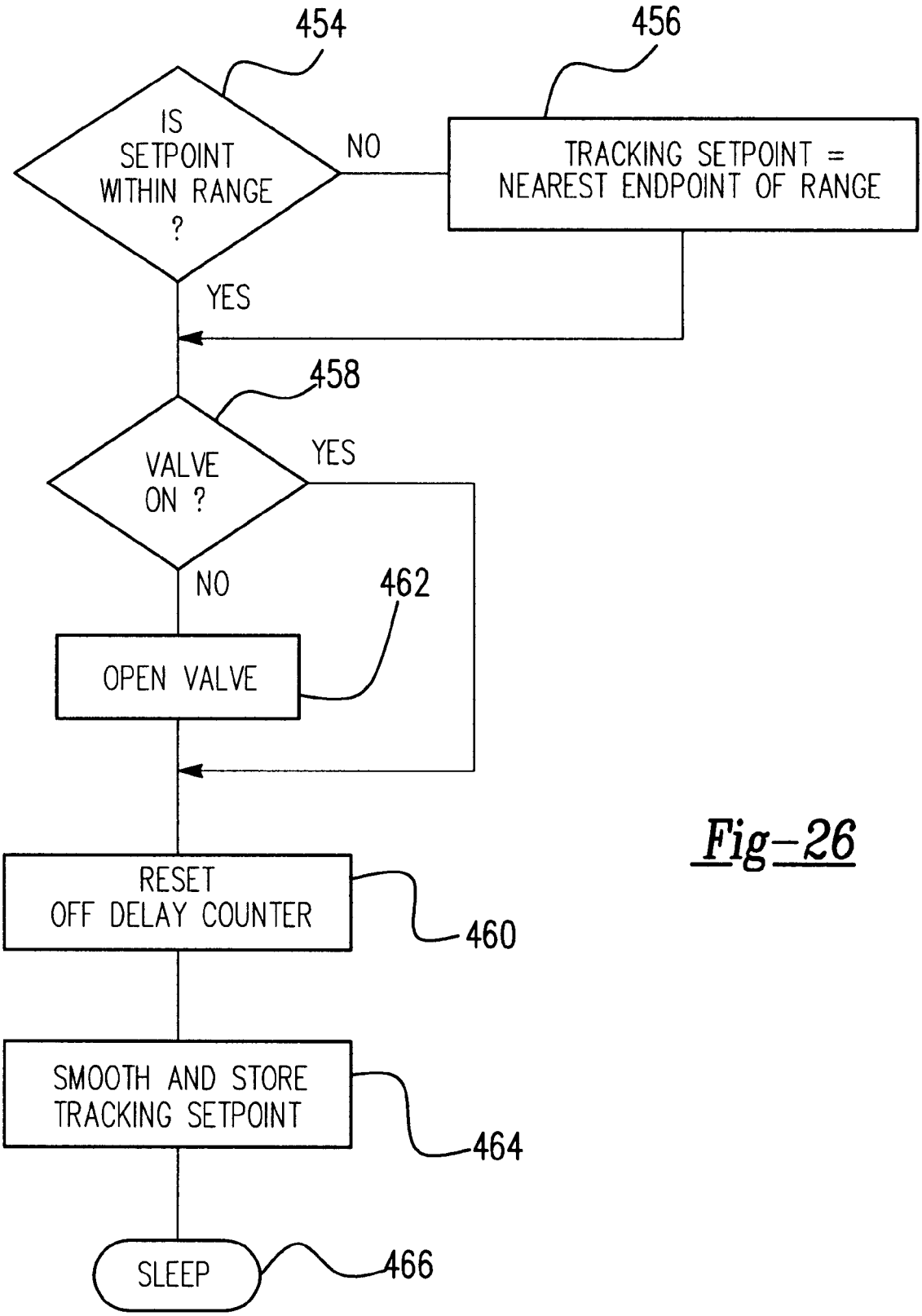
FIG. 26 is a flow chart depicting the routine carried out after the tracking routine of FIG. 25 has been unable to track the sensor signals.

Turning now to FIG. 26, there is shown the portion of the program executed when the tracking routine has failed; that is, when the signal from the receiver is outside the window. The first step is a check at block 454 to determine if, over the last one or more iterations of the tracking routine, the tracking setpoint has been adjusted beyond one of the boundaries of a range of values about the calibration point. If the setpoint is not within range, then at block 456 it is set equal to the nearest boundary, or endpoint, of the range. This limits the maximum amount by which the setpoint is allowed to drift before being reset to the stored calibration point (which occurs following shut-off of water flow and during re-calibration). Preferably, the size of the range is selected to be big enough to accommodate adjustments to the setpoint due only to IR reflections from the water stream when no object is present, but small enough so that reflections from an object in the water stream will cause the tracking routine to attempt to drive the setpoint outside of the range.

From both blocks 454 and 456 the program moves to block 458 where a check is made to determine if the valve is already in the open position. If so, the program moves to block 460 where the Off Delay Counter is reset to zero. This counter is used to continue the water flow for a short time (e.g., two seconds) after an object is no longer detected in front of the faucet. If the valve is not already open, then the program opens the valve at block 462 before resetting the Off Delay Counter. The program then moves to block 464 where the tracking setpoint is smoothed by averaging it with its value at the end of the previous iteration through the tracking routine. This smoothed setpoint is then stored for use as the starting setpoint for the next iteration of the tracking routine. Thereafter, the microprocessor is put into its sleep mode, as indicated at block 466.

Figure 27:
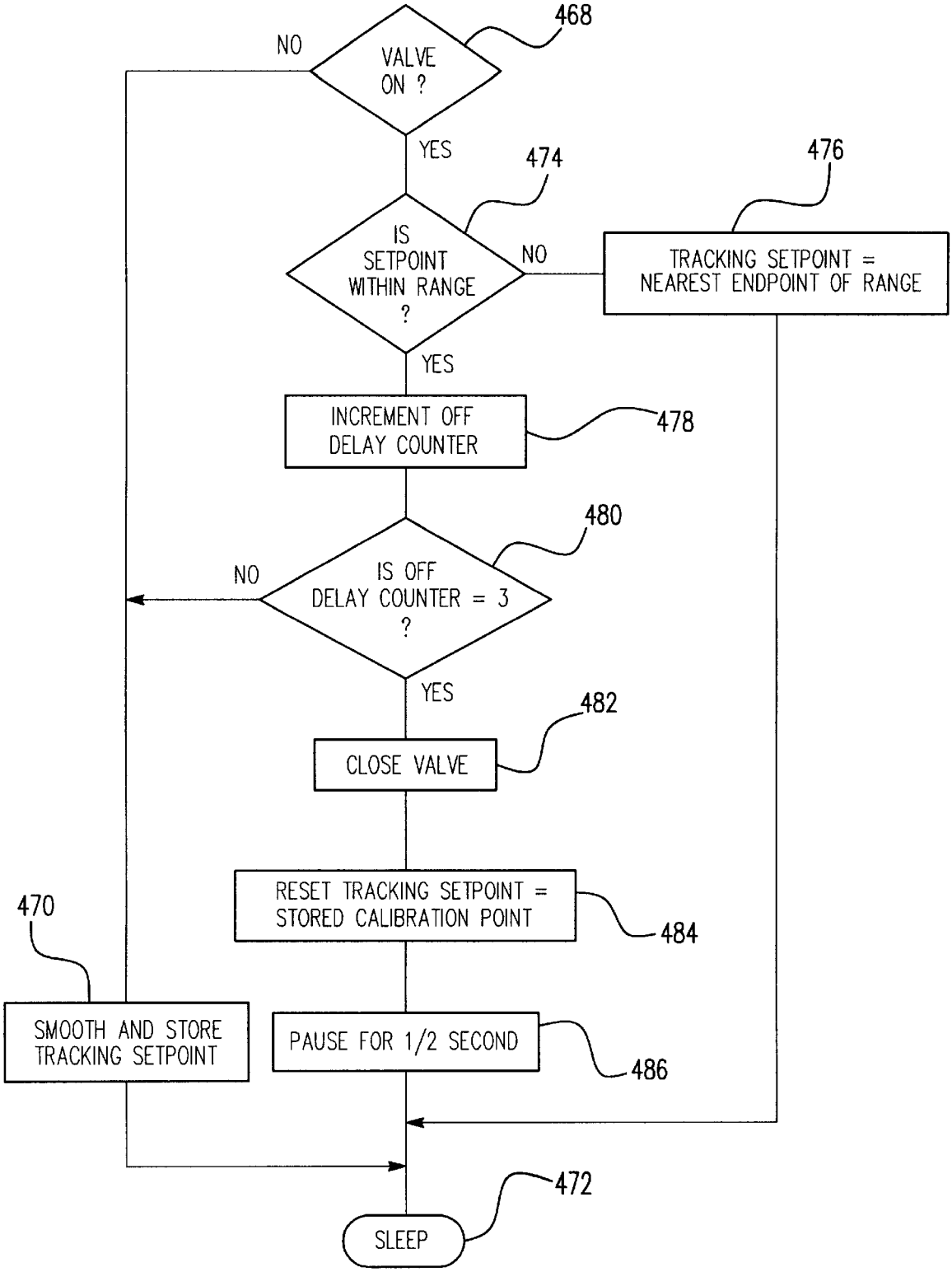
FIG. 27 is a flow chart depicting the routine carried out after the tracking routine of FIG. 25 has successfully tracked the sensor signals.

Finally, referring to FIG. 27, there is shown the portion of the program that is executed when the sensor signal was successfully tracked. This portion of the program determines whether the object is still present and, if not, provides a short delay before closing the valve. The first step is to determine at block 468 whether the valve is in its open state. If not, then the program need only smooth and store the setpoint as in block 464 of FIG. 26 before entering sleep mode. This is indicated at blocks 470 and 472. However, if the valve is open, then the program needs to determine whether an object is still present. As will be appreciated by those skilled in the art, once an object is no longer present, the signal from the IR receiver will return to a level approximately equal to the stored calibration point, with the difference between the signal and the calibration point being due primarily to the effect of the water stream on the reflection of IR light. Thus, by examining the amount of variation of the setpoint (which tracks or nearly tracks the sensor signal) from the stored calibration point, the program can determine whether or not an object is still present. This is done at block 474 where the setpoint is checked to determine if it is within a range, or window, about the stored calibration point. This is the same test performed at block 454 of FIG. 26.

If the setpoint is not within the range, then, at block 476, it is set to the nearest boundary of the range and the microprocessor then enters sleep mode. If it is in range, then the program assumes that no object is present and the. Off Delay Counter is incremented at block 478. Then, the Off Delay Counter is checked at block 480. As mentioned above, the Off Delay Counter is used to continue water flow for a short time after the object is no longer detected and, as will be appreciated, it indicates the number of successive iterations in which the tracking routine successfully tracked the sensor signal and determined that the object was no longer present. If there have not been enough of these successive iterations, then the valve is left open and the process moves to block 470. However, once there have been three such iterations, the program moves to block 482 where the valve is closed, followed by a reset of the tracking setpoint to make it equal to the stored calibration point, as indicated at block 484. Thereafter, the microprocessor is put into the sleep mode.

As will be appreciated from the foregoing discussion of the preferred embodiment, when the valve is closed, the detection of an object involves determining whether the sensor signal varies outside of a window that is centered about the tracking setpoint (which changes from iteration to iteration), whereas, once the valve is open, the determination that the object is no longer present involves determining whether the setpoint (and thus the sensor signal) is within a different window that is centered about the stored calibration point. Thus, the illustrated embodiment uses a window that floats with the setpoint to detect the initial presence of an object and uses a fixed window (subject only to the small, gradual adjustments to the calibration point) to detect the disappearance of the object from the sensor's view.

It will thus be apparent that there has been provided in accordance with the present invention an electronic faucet method and apparatus which achieves the aims and advantages specified herein. It will of course be understood that the foregoing description is of a preferred exemplary embodiment of the invention and that the invention is not limited to the specific embodiment shown. Various changes and modifications will become apparent to those skilled in the art and all such variations and modifications are intended to come within the scope of the appended claims.

We claim:

1. An electronic faucet, comprising:

a spout having a housing that extends from a base end of said housing to a distal free end of said housing, said base end having a substantially planar mounting surface;

an infra-red detector supported within said housing proximate said base end, said housing having an outer surface with said detector being recessed from said outer surface, said infra-red detector having an optical axis oriented in a direction that is parallel to the plane in which said mounting surface lies, and said optical axis extending through an opening in said outer surface of said housing at a location in which said outer surface forms an obtuse angle with said mounting surface.

2. An electronic faucet as defined in claim 1, wherein said infra-red detector comprises an active IR detector having an infra-red transmitter and infra-red receiver, with said transmitter and receiver each having an optical axis that is oriented towards each other and in a direction that is generally parallel to the plane in which said mounting surface lies.

3. An electronic faucet as defined in claim 1, wherein said optical axis forms an angle of approximately five degrees relative to an imaginary line that is normal to said outer surface at the location in which said optical axis extends through said housing.

4. An electronic faucet, comprising:

a spout having a housing that extends from a base end of said housing to a distal free end of said housing;

a spout tube extending through said housing from an opening in said base end to an opening in said free end;

a valve having a water inlet, a water outlet, and at least one input that controls switching of said valve between an open state and a closed state, wherein said valve permits water flow through said valve between said inlet and said outlet when in said open state and prevents water flow through said valve between said inlet and said outlet when in said closed state;

an electronic control circuit coupled to said input of said valve, said circuit including a microprocessor, a memory accessible by said microprocessor, a control program stored in said memory, and a sensor coupled to said microprocessor, said sensor being supported by said housing and being operable to generate a signal indicative of the presence or absence of objects located within a region of space near said housing; and said control circuit including a support member that supports said microprocessor and memory in said spout, said support member having a first surface portion in contact with said spout tube and at least one other surface portion in contact with said housing.

5. An electronic faucet as defined in claim 4, wherein said spout tube has a curved outer surface and wherein said first surface portion comprises a curved recess in contact with said curved outer surface of said spout tube.

6. An electronic faucet as defined in claim 4, wherein said support member comprises an electronics housing with said microprocessor and memory being supported on a printed circuit board within said electronics housing.

7. An electronic faucet, comprising:

a spout having a housing that extends from a base end of said housing to a distal free end of said housing;

a spout tube that extends through said housing from an opening in said base end to an opening in said free end;

a valve having a water inlet, a water outlet, and at least one input that controls switching of said valve between an open state and a closed state, wherein said valve permits water flow through said valve between said inlet and said outlet when in said open state and prevents water flow through said valve between said inlet and said outlet when in said closed state;

an electronic control circuit coupled to said input of said valve, said circuit including a microprocessor, a memory accessible by said microprocessor, a control program stored in said memory, and a sensor coupled to said microprocessor, said sensor being supported by said housing and being operable to generate a signal indicative of the presence or absence of objects located within a region of space near said housing;

said control circuit including a support member that supports said microprocessor and memory in said spout, said support member having first and second sides and being retained in said housing by contact with said first side at opposite ends of said support member and with said second side at one or more intermediate locations.

8. An electronic faucet as defined in claim 7, wherein said support member includes a bearing surface at said first end, with said bearing surface being in contact with said spout tube.

9. An electronic faucet as defined in claim 7, wherein said support member comprises an electronics housing with said microprocessor and memory being supported on a printed circuit board within said electronics housing.

10. A spout assembly for an electronic faucet, comprising:

a spout housing that extends from a base end of said housing to a distal free end of said housing;

a spout tube that extends through said housing from an opening in said base end to an opening in said free end; and an electronics module interposed between said spout tube and said spout housing, said electronics module being retained in place within said spout housing by contact of said electronics module with said spout tube and said spout housing.

11. A spout assembly as defined in claim 10, wherein said spout housing comprises an upper housing and a lower housing with said upper and lower housings being fastened together about said spout tube, and wherein said module is fixedly interposed between said spout tube and said lower housing.

12. A spout assembly as defined in claim 11, further comprising at least two posts extending between said upper and lower housings with said upper and lower housings being secured together by fasteners that extend into said posts, wherein said electronics module includes recesses proximate said posts.

13. A spout assembly as defined in claim 10, further comprising a spout tube assembly that includes said spout tube, wherein said electronics module has upper and a lower ends in abutment with said spout tube assembly and has at least one intermediate portion in abutment with said spout housing.

14. A spout assembly as defined in claim 13, wherein said spout tube assembly includes a mounting shank disposed about said spout tube, and wherein said lower end of said electronics module abuts against a front surface of said shank.

15. An electronic faucet, comprising:

a spout having a first housing that extends from a base end of said housing to a distal free end of said housing, said first housing having an opening at a location intermediate said base end and said free end;

a second housing located within said first housing and having a unitary protruding portion that extends into said opening, said second housing being formed of an infra-red transmissive material;

an infra-red detector supported within said protruding portion of said second housing, said detector having a field of view that extends through a front surface of said protruding portion.

16. An electronic faucet as defined in claim 15, further comprising a sensor housing located within said protruding portion, wherein said sensor housing supports said detector within said protruding portion.

17. An electronic faucet as defined in claim 16, wherein said sensor housing is formed of rubber.

18. An electronic faucet as defined in claim 17, wherein said sensor housing fits tightly into said protruding portion with said detector being pressed into bores within said sensor housing, and wherein said sensor housing and detector are sealed into place at said protruding portion by a potting compound.

19. An electronic faucet as defined in claim 16, wherein said detector includes an infra-red transmitter and infra-red receiver and said sensor housing includes a pair of bores into which said transmitter and receiver extend, wherein said transmitter and receiver each has a field of view and each of said bores has an orientation relative to the other of said bores, with the relative orientations determining the field of view of said receiver relative to the field of view of said transmitter.

20. An electronic faucet as defined in claim 15, further comprising a control circuit connected to said detector, wherein said second housing supports said control circuit within said first housing.

21. An electronic faucet as defined in claim 15, further comprising a light emitting diode that produces visible light at least one frequency, wherein said diode is supported within said protruding portion of said second housing, and wherein said second housing is transmissive to light at said frequency.

* * * * *